US012716425B2

(12) United States Patent
Kim et al.

(10) Patent No.: US 12,716,425 B2
(45) Date of Patent: Aug. 25, 2026

(54) METHOD OF DESIGNING SINGLE-CHANNEL PUMP AND SINGLE-CHANNEL PUMP

(71) Applicant: KOREA INSTITUTE OF INDUSTRIAL TECHNOLOGY, Cheonan-si (KR)

(72) Inventors: Jin Hyuk Kim, Incheon (KR); Sung Kim, Cheonan-si (KR); Soon Young Jeong, Cheonan-si (KR); Duc Anh Nguyen, Cheonan-si (KR); Min Su Roh, Cheonan-si (KR)

(73) Assignee: KOREA INSTITUTE OF INDUSTRIAL TECHNOLOGY, Cheonan-si (KR)

( * ) Notice: Subject to any disclaimer, the term of this patent is extended or adjusted under 35 U.S.C. 154(b) by 0 days.

(21) Appl. No.: 18/698,357

(22) PCT Filed: Nov. 30, 2022

(86) PCT No.: PCT/KR2022/019206
§ 371 (c)(1),
(2) Date: Apr. 4, 2024

(87) PCT Pub. No.: WO2024/101514
PCT Pub. Date: May 16, 2024

(65) Prior Publication Data

US 2025/0264115 A1 Aug. 21, 2025

(30) Foreign Application Priority Data

Nov. 10, 2022 (KR) ..... 10-2022-0149968

(51) Int. Cl.
*F04D 29/42* (2006.01)
*F04D 1/00* (2006.01)
*F04D 29/22* (2006.01)

(52) U.S. Cl.
CPC ..... *F04D 29/4293* (2013.01); *F04D 1/00* (2013.01); *F04D 29/2216* (2013.01)

(58) Field of Classification Search
CPC .... F04D 29/4293; F04D 29/2216; F04D 1/00; F04D 29/426; F04D 29/225; F04D 29/22;
(Continued)

(56) References Cited

U.S. PATENT DOCUMENTS 4,917,571 A * 4/1990 Hyll ..... F04D 29/445 415/128
5,127,800 A * 7/1992 Hyll ..... F04D 29/4286 415/197
(Continued)

FOREIGN PATENT DOCUMENTS

CN 106570263 A * 4/2017 ..... G06F 30/17
CN 114109906 A * 3/2022 ..... F04D 29/426
(Continued)

OTHER PUBLICATIONS

Choi et al. KR101808077-Espacenet—English Machine Translation (Year: 2018).*
(Continued)

*Primary Examiner* — Nathaniel E Wiehe
*Assistant Examiner* — Wayne A Lambert
(74) *Attorney, Agent, or Firm* — CANTOR COLBURN LLP

(57) ABSTRACT

One embodiment of the present invention provides a technology that optimally designs a single-channel pump and improves performance such as high efficiency and low vibration of the single-channel pump. A method of designing a single-channel pump according to an embodiment of the present invention includes a first step of determining a shape of a volute and setting a plurality of points inside and outside the volute, a second step of selecting a target value, which
(Continued)

is a value for a performance numerical value of the single-channel pump, and determining a shape of an impeller suitable for the target value, a third step of setting an analytical cross-sectional area, which is a channel cross-sectional area that adjoins inner and outer points in the volute, and setting a plurality of analytical cross-sectional areas for a plurality of portions in the volute, a fourth step of setting a structure design variable, which is a structural variable of the single-channel pump, and deriving the target value by a numerical analysis, and a fifth step of deriving, as a design plan, a structure design variable value that is a value of the structure design variable that allows the target value to satisfy a preset set target value.

12 Claims, 46 Drawing Sheets

(58) Field of Classification Search
CPC ..... G06F 2113/08; G06F 2119/14; G06F 2111/04; G06F 2111/10; G06F 30/17; G06F 30/23
See application file for complete search history.

(56) References Cited

U.S. PATENT DOCUMENTS 5,813,833 A * 9/1998 Addie ..... F04D 7/04 415/206
2004/0126228 A1* 7/2004 Roudnev ..... F04D 29/426 415/196
2010/0284812 A1* 11/2010 Zahdeh ..... F04D 29/2216 416/185
2011/0311357 A1 12/2011 Rodrigues
2014/0037440 A1* 2/2014 Frater ..... F04D 29/4286 415/203
2014/0086736 A1* 3/2014 Ree ..... F04D 7/04 415/206
2014/0093407 A1* 4/2014 Calkins ..... F01D 15/08 415/214.1
2018/0328382 A1* 11/2018 Henseler ..... A61M 60/178
2022/0074427 A1* 3/2022 Kim ..... F04D 15/0088

FOREIGN PATENT DOCUMENTS

EP 3211245 A1 * 8/2017 ..... F04D 29/428
JP 2005240763 A * 9/2005
KR 20060128369 A 12/2006
KR 101474102 B1 12/2014
KR 20170034174 A * 3/2017 ..... F04D 29/4226
KR 101812423 B1 * 12/2017 ..... F04D 29/486
KR 101808077 B1 1/2018
KR 102037219 B1 10/2019
KR 102219500 B1 2/2021

OTHER PUBLICATIONS

Kim et al. KR101812423 Espacenet—English Machine Translation (Year: 2017).*
Kim et al. KR102219500 Espacenet—English Machine Translation (Year: 2021).*
McDavid—Macroscopic Modeling—Encyclopedia of Materials Science and Technology, ISBN: 0-08-0431526 pp. 4720-4733 (Year: 2001).*
Wu et al. CN 106570263-English Machine Translation-Espacenet (Year: 2017).*
International Search Report mailed Jul. 17, 2023 for PCT/KR2022/019206, In conformance with MPEP 609—Concise explanation of the relevance includes issue date of foreign OA and references cited therein.

* cited by examiner

FIG. 14

(a)

| 4KW - 220mm | Inlet to Measuring Plane (256mm) | | | Inlet to Outlet | |
|---|---|---|---|---|---|
| Q (CMM) | Efficiency (%) | Hf (m) | Torque (Nm) | Efficiency (%) | Hf (m) |
| 0.2 | 26.7313 | 13.4295 | 11.5088 | 84.5521 | 14.3322 |
| 0.6 | 52.2793 | 11.2049 | 13.7104 | 82.1591 | 11.1791 |
| 1 | 81.6364 | 10.8256 | 14.5187 | 80.2656 | 10.7758 |
| 1.4 | 90.3229 | 10.3345 | 17.0813 | 89.9728 | 10.2888 |
| 1.8 | 90.9343 | 9.27243 | 19.559 | 90.3945 | 9.21738 |
| 2.2 | 89.7594 | 8.23332 | 21.5154 | 88.5818 | 8.16139 |
| 2.6 | 87.3675 | 7.08961 | 22.4543 | 86.0076 | 6.97926 |

(b)

| 5.5KW - 232mm | Inlet to Measuring Plane (256mm) | | | Inlet to Outlet | |
|---|---|---|---|---|---|
| Q (CMM) | Efficiency (%) | Hf (m) | Torque (Nm) | Efficiency (%) | Hf (m) |
| 0.2 | 20.4808 | 14.3144 | 15.1537 | 20.3103 | 14.2538 |
| 0.6 | 51.173 | 12.5031 | 15.3331 | 52.0945 | 12.4842 |
| 1 | 76.2555 | 11.9431 | 16.6937 | 76.0997 | 11.9177 |
| 1.4 | 86.0633 | 11.4266 | 19.0808 | 86.3750 | 11.3834 |
| 1.8 | 88.3639 | 10.3562 | 22.0089 | 88.8417 | 10.4942 |
| 2.2 | 88.3808 | 9.45428 | 25.0914 | 87.7031 | 9.38178 |
| 2.6 | 86.3266 | 8.31828 | 26.6655 | 85.2526 | 8.20639 |

(a)

(b)

| Pressure | 220mm | Company |
|---|---|---|
| Imp. Interf. Side | 81081.9 | 82110.4 |
| Vol. Interf. Side | 78020.4 | 80892.6 |

| Velocity | 220mm | Company |
|---|---|---|
| Imp. Interf. Side | 10.1474 | 11.0736 |
| Vol. Interf. Side | 7.3997 | 6.8952 |

METHOD OF DESIGNING SINGLE-CHANNEL PUMP AND SINGLE-CHANNEL PUMP

TECHNICAL FIELD

The present invention relates to a method of designing a single-channel pump, and more particularly, to a technology for optimally designing a single-channel pump and improving performance such as high efficiency and low vibration of the single-channel pump.

BACKGROUND ART

Unlike general submersible pumps, wastewater pumps are configured to move fluids containing foreign substances, and for this reason, channels of the wastewater pumps are frequently clogged. In order to prevent this problem, the wastewater pump needs to have a channel with a large cross-sectional area and to generate an output that conforms to a required level.

A single-channel pump, which is used as the wastewater pump, is excellent in transmitting foreign substances containing solidified materials because the single-channel pump may ensure channels. However, because the channels are twisted, costs required to manufacture the single-channel pump are increased. Therefore, in order to optimally design a volute casing in consideration of the installation of an impeller of 4 or 5.5 kW class, a plurality of points are set inside and outside the volute casing, and a cross-sectional area of a channel including one inner point and one outer point, which are adjacent to each other, is analyzed. Therefore, the volute casing may be optimally designed on the basis of the analysis data.

Korean Patent No. 10-1474102 (entitled Method of Optimally Designing Impeller Shape) discloses a method including: step S1 of obtaining a design variable related to an objective function by a design variable calculation means; step S2 of setting a region for forming an artificial intelligence network from the design variable obtained in step S1 as an experimental planning method by an artificial intelligence network forming region setting means; step S3 of forming the artificial intelligence network on the basis of the region set in step S2 by an artificial intelligence network forming means; step S4 of applying a genetic algorithm to improve the artificial intelligence network by an artificial intelligence network improving means to improve the artificial intelligence network to an optimal artificial intelligence network by increasing the generation of the genetic algorithm; and step S5 of deriving an global optimization result by using the artificial intelligence network formed in step S4 by an impeller shape derivation means.

Document of Related Art

Korean Patent No. 10-1474102

DISCLOSURE

Technical Problem

The present invention has been made in an effort to solve the above-mentioned problem, and an object of the present invention is to optimally design a single-channel pump and improve performance such as high efficiency and low vibration of the single-channel pump.

Technical problems to be solved by the present invention are not limited to the above-mentioned technical problems, and other technical problems, which are not mentioned above, may be clearly understood from the following descriptions by those skilled in the art to which the present invention pertains.

Technical Solution

In order to achieve the above-mentioned object, the present invention provides a method of designing a single-channel pump including a volute configured to provide a turning channel to a fluid introduced from the outside, and an impeller configured to rotate and having a single channel through which the fluid having passed through the volute passes, the method including: a first step of determining a shape of the volute and setting a plurality of points inside and outside the volute; a second step of selecting a target value, which is a value for a performance numerical value of the single-channel pump, and determining a shape of the impeller suitable for the target value; a third step of setting an analytical cross-sectional area, which is a channel cross-sectional area that adjoins inner and outer points in the volute, and setting a plurality of analytical cross-sectional areas for a plurality of portions in the volute; a fourth step of setting a structure design variable, which is a structural variable of the single-channel pump, and deriving the target value by a numerical analysis; and a fifth step of deriving, as a design plan, a structure design variable value that is a value of the structure design variable that allows the target value to satisfy a preset set target value.

In the embodiment of the present invention, the structure design variable may be a maximum diameter of the volute.

In the embodiment of the present invention, in the second step, the target value may be an output of the single-channel pump.

In the embodiment of the present invention, in the fourth step, a finite volume method may be used for the numerical analysis.

In the embodiment of the present invention, the structure design variable value may be changed by determining a shape of the impeller.

In the embodiment of the present invention, the target value may be changed by changing the structure design variable value.

In the embodiment of the present invention, the impeller may have a rotation channel that is a channel configured to connect an inlet port at a lower side and an outlet port at a lateral side and having a spiral shape.

In the embodiment of the present invention, the volute may have a spiral part that is a spiral portion surrounding the impeller, and the volute may discharge the fluid, which has passed through the impeller, to the outside.

In the embodiment of the present invention, a channel cross-sectional shape of the spiral part may be a rectangular shape having an edge portion curved toward the outside.

Advantageous Effects

According to the effect of the present invention configured as described above, in order to perform the optimization design, the plurality of points is formed inside and outside the volute, and the channel cross-sectional area including the adjacent inner and outer points is analyzed, such that the efficiency of the optimization design may be improved.

Further, according to the effect of the present invention, because the optimization design is performed on the single-channel pump as described above, it is possible to improve the performance of the single-channel pump and prevent the single channel from being clogged by a solidified material passing through the single channel.

The effects of the present invention are not limited to the above-mentioned effects, and it should be understood that the effects of the present invention include all effects that may be derived from the configuration of the present invention disclosed in the detailed description of the present invention or the appended claims.

DESCRIPTION OF DRAWINGS

FIG. 14 is a table showing performance for each flow rate of a fluid passing through the single-channel pump according to the embodiment of the present invention.

BEST MODE

Figure 1:
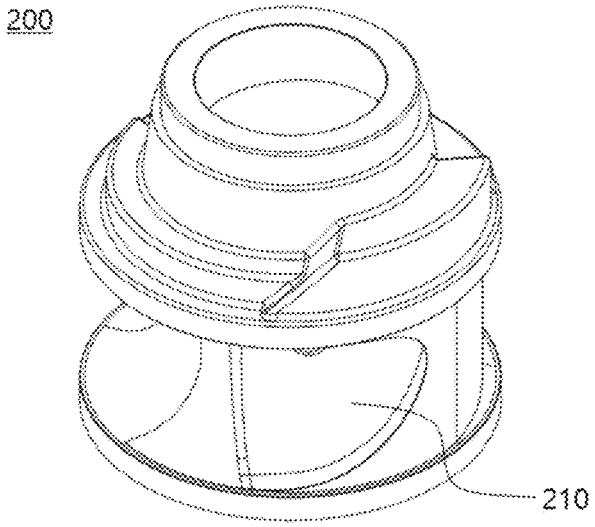
FIG. 1 is a perspective view of an impeller according to an embodiment of the present invention.

The most exemplary embodiment according to the present invention provides a method of designing a single-channel pump including a volute configured to provide a turning channel to a fluid introduced from the outside, and an impeller configured to rotate and having a single channel through which the fluid having passed through the volute passes, the method including: a first step of determining a shape of the volute and setting a plurality of points inside and outside the volute; a second step of selecting a target value, which is a value for a performance numerical value of the single-channel pump, and determining a shape of the impeller suitable for the target value; a third step of setting an analytical cross-sectional area, which is a channel cross-sectional area that adjoins inner and outer points in the volute, and setting a plurality of analytical cross-sectional areas for a plurality of portions in the volute; a fourth step of setting a structure design variable, which is a structural variable of the single-channel pump, and deriving the target value by a numerical analysis; and a fifth step of deriving, as a design plan, a structure design variable value that is a value of the structure design variable that allows the target value to satisfy a preset set target value.

MODE FOR INVENTION

Hereinafter, the present invention will be described with reference to the accompanying drawings. However, the present invention may be implemented in various different ways and is not limited to the embodiments described herein. Further, a part irrelevant to the description will be omitted in the drawings in order to clearly describe the present invention, and similar constituent elements will be designated by similar reference numerals throughout the specification.

Throughout the present specification, when one constituent element is referred to as being "connected to (coupled to, in contact with, or linked to)" another constituent element, one constituent element can be "directly connected to" the other constituent element, and one constituent element can also be "indirectly connected to" the other element with other elements interposed therebetween. In addition, unless explicitly described to the contrary, the word "comprise/include" and variations such as "comprises/includes" or "comprising/including" will be understood to imply the inclusion of stated elements, not the exclusion of any other elements.

The terms used in the present specification are used only for the purpose of describing particular embodiments and are not intended to limit the present invention. Singular expressions include plural expressions unless clearly described as different meanings in the context. In the present specification, it should be understood the terms "comprises," "comprising," "includes," "including," "containing," "has," "having" or other variations thereof are inclusive and therefore specify the presence of stated features, integers, steps, operations, elements, components, or combinations thereof, but do not preclude the presence or addition of one or more other features, integers, steps, operations, elements, components, or combinations thereof.

Hereinafter, the present invention will be described in detail with reference to the accompanying drawings.

Figure 2:
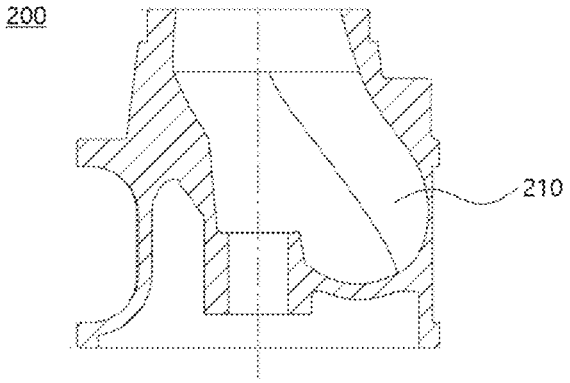
FIG. 2 is a cross-sectional view of the impeller according to the embodiment of the present invention.
Figure 3:
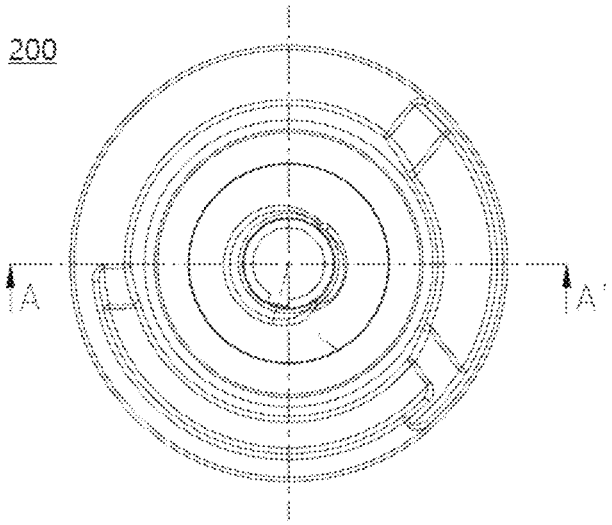
FIG. 3 is a top plan view of the impeller according to the embodiment of the present invention.

FIG. 1 is a perspective view of an impeller 200 according to a first embodiment of the present invention, FIG. 2 is a cross-sectional view of the impeller 200 according to the first embodiment of the present invention, and FIG. 3 is a top plan view of the impeller 200 according to the first embodiment of the present invention. In this case, FIG. 2 is a cross-sectional view taken along line A-A' in FIG. 3.

Figure 4:
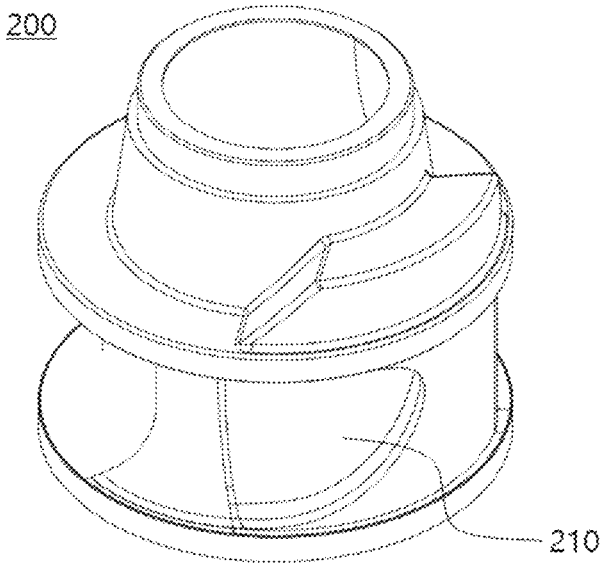
FIG. 4 is a perspective view of an impeller according to another embodiment of the present invention.
Figure 5:
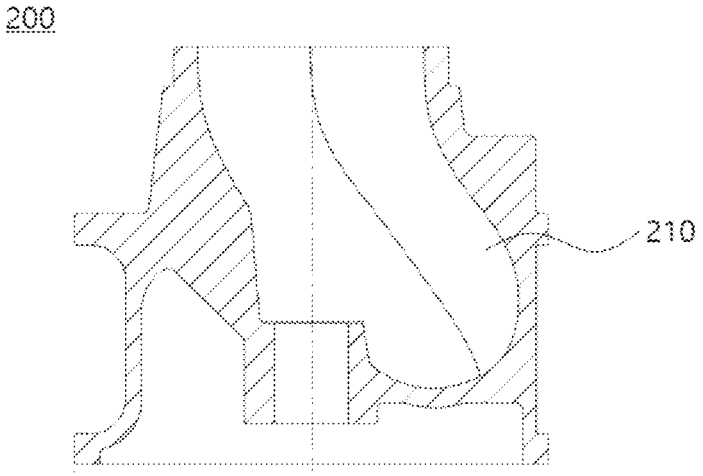
FIG. 5 is a cross-sectional view of the impeller according to another embodiment of the present invention.
Figure 6:
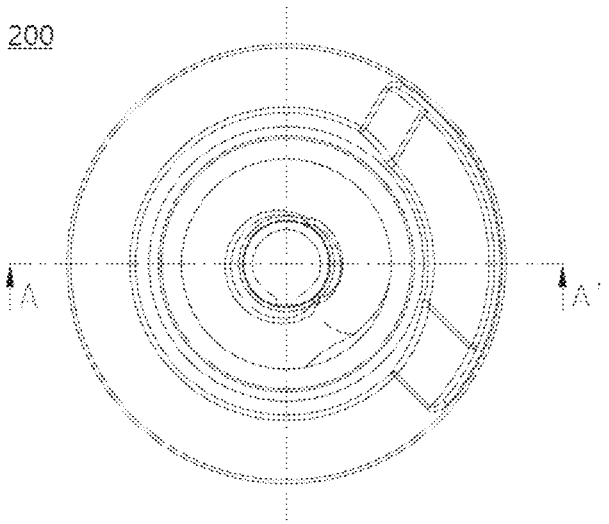
FIG. 6 is a top plan view of the impeller according to another embodiment of the present invention.

In addition, FIG. 4 is a perspective view of an impeller 200 according to a second embodiment of the present invention, FIG. 5 is a cross-sectional view of the impeller 200 according to the second embodiment of the present invention, and FIG. 6 is a top plan view of the impeller 200 according to the second embodiment of the present invention. In this case, FIG. 5 is a cross-sectional view taken along line A-A' in FIG. 6.

Figure 7:
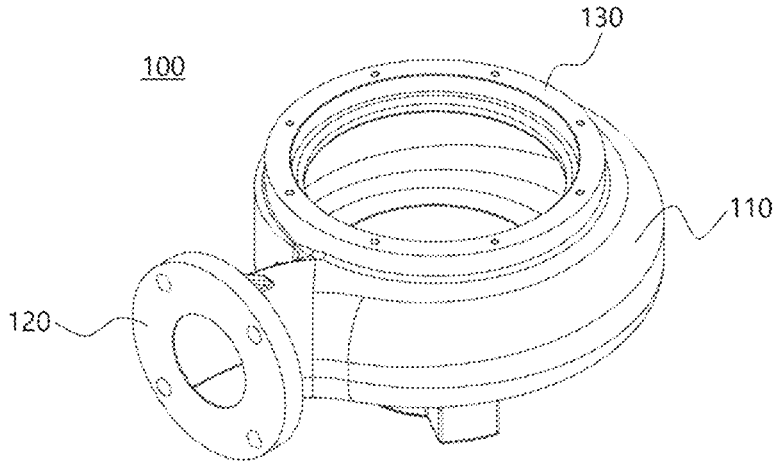
FIG. 7 is a perspective view of a casing according to the embodiment of the present invention.
Figure 8:
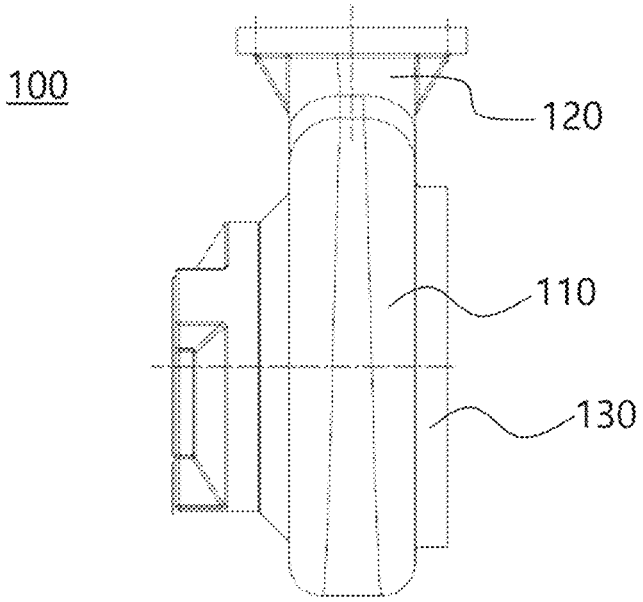
FIG. 8 is a side view illustrating the casing according to the embodiment of the present invention.
Figure 9:
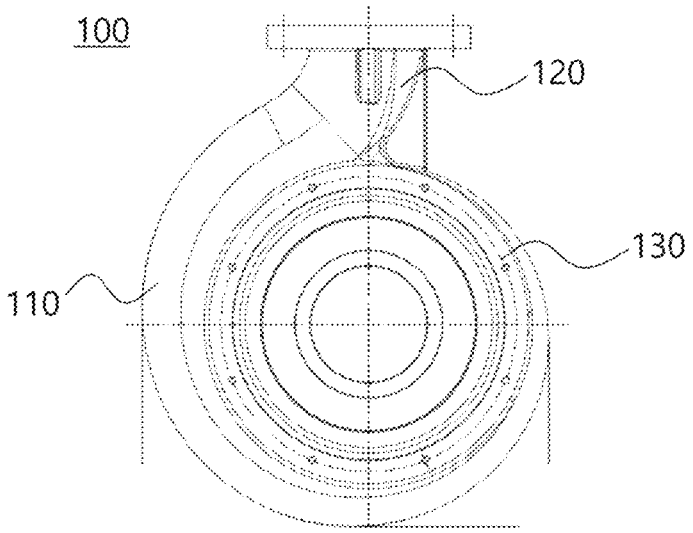
FIG. 9 is a top plan view of the casing according to the embodiment of the present invention.
Figure 10:
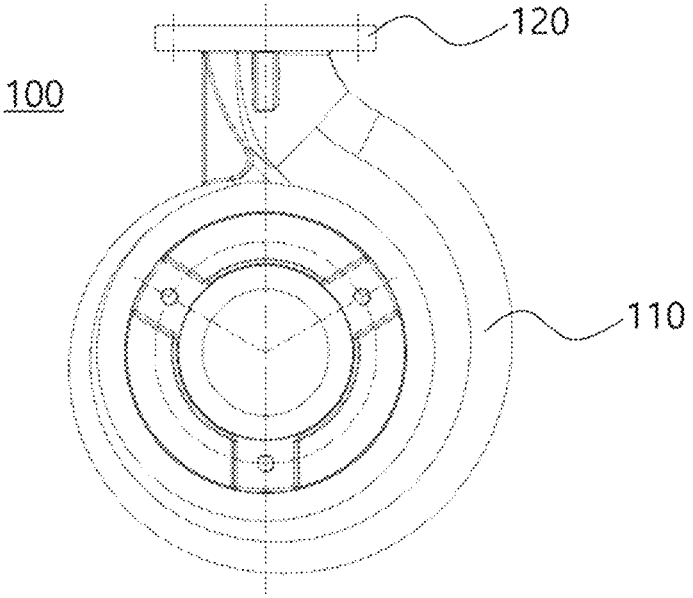
FIG. 10 is a bottom plan view of the casing according to the embodiment of the present invention.

Further, FIG. 7 is a perspective view of a casing according to the embodiment of the present invention, FIG. 8 is a side view illustrating the casing according to the embodiment of the present invention, FIG. 9 is a top plan view of the casing according to the embodiment of the present invention, and FIG. 10 is a bottom plan view of the casing according to the embodiment of the present invention.

In this case, FIGS. 1 to 3 are views illustrating a single-channel pump of the present invention that generates an output of 4 kW, and FIGS. 4 to 6 are views illustrating a single-channel pump of the present invention that generates an output of 5.5 kW.

As illustrated in FIGS. 1 to 6, the single-channel pump of the present invention includes a volute 100 configured to provide a turning channel to a fluid introduced from the outside, and the impeller 200 configured to rotate and having a single channel through which the fluid having passed through the volute 100 passes.

In addition, as illustrated in FIGS. 7 to 10, the volute 100 has a spiral part 110 that is a spiral portion surrounding the impeller 200. The volute 100 may discharge the fluid, which has passed through the impeller 200, to the outside. Further, the volute 100 may have an outlet pipe 120 coupled to the spiral part 110 and configured to allow the fluid, which has passed through the spiral part 110, to be discharged through the outlet pipe 120.

Further, the single-channel pump of the present invention may have an inlet pipe 130 coupled to the spiral part 110 and configured to allow the outside fluid to be supplied into a space of the spiral part 110 in which the impeller 200 is positioned.

Because the volute 100 has the spiral part 110, a channel space, through which the fluid may pass, may extend in a circumferential direction. Specifically, the channel of the volute 100, through which the fluid may pass, may spirally extend in the circumferential direction, and an outlet may be formed in the volute 100 so that the fluid may be introduced or discharged through the outlet.

Further, the impeller 200 may have a rotation channel 210 that is a channel configured to connect an inlet port at a lower side and an outlet port at a lateral side and having a spiral shape. That is, the impeller 200 may be a bladeless impeller 200. The impeller 200 may prevent a breakdown and damage caused by clogging at the time of pumping the fluid.

The impeller 200 may have an approximately cylindrical shape and be curvedly formed. The fluid, which is introduced into the inlet port of the rotation channel 210 by a rotation of the impeller 200, may be discharged to the outlet port of the rotation channel 210 and flow to the spiral part 110 of the volute 100.

The impeller 200 may be provided in the volute 100 and rotatably coupled to the volute 100 to introduce and discharge the fluid. Further, the impeller 200 may be connected to a driving shaft connected to a motor, and the impeller 200 may be rotated by power from the motor. The impeller 200 may be configured to pump the fluid by allowing the fluid, which is introduced into the rotation channel 210, to flow by using a centrifugal force when the impeller 200 rotates.

Hereinafter, a designing method of the present invention for optimally designing the single-channel pump of the present invention will be described. The following processes performed in first to fifth steps may be performed by design analysis part equipped with software such as a numerical analysis program. In this case, the design analysis part may be a computer or the like.

Further, hereinafter, for convenience of description, an angle of the volute 100 at a point, at which a smallest cross-sectional area is positioned among cross-sectional areas of an inner channel of the volute 100, may be set to 0 degrees, and an angle of the volute 100 at a point, at which a largest cross-sectional area is positioned, may be set to 360 degrees.

Figure 11:
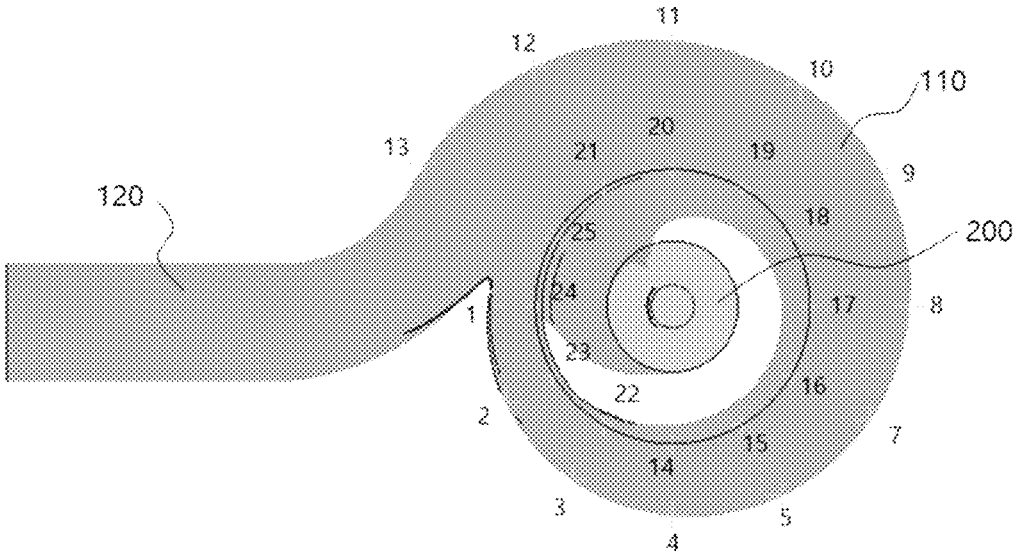
FIG. 11 is an image related to the setting of a plurality of points according to the embodiment of the present invention.
Figure 12:
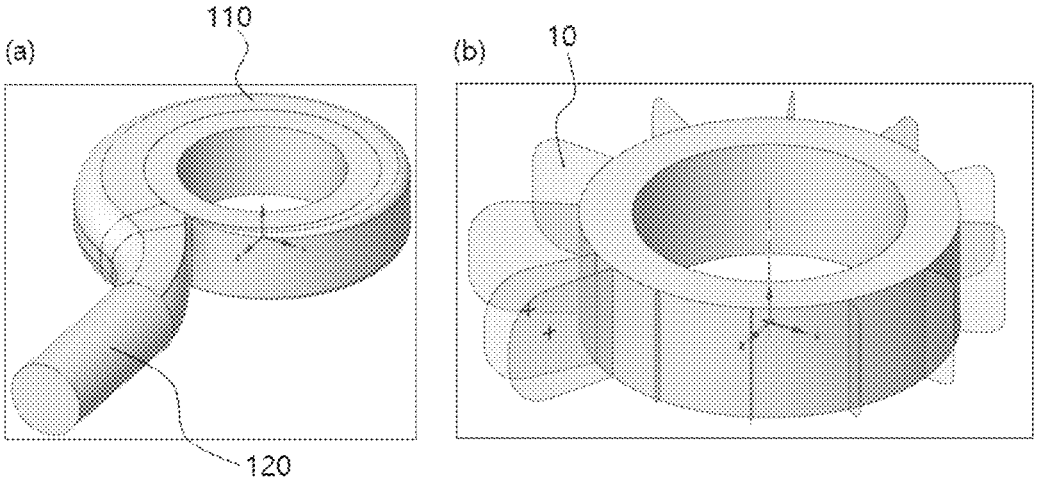
FIG. 12 is an image related to a numerical analysis on a volute according to the embodiment of the present invention.

Further, FIG. 11 is an image related to the setting of a plurality of points according to the embodiment of the present invention, and FIG. 12 is an image related to a numerical analysis on the volute 100 according to the embodiment of the present invention.

In this case, FIG. 11(*a*) is an image related to a result of performing three-dimensional modeling on the channel in the volute 100 through which the fluid passes in order to perform the numerical analysis, and FIG. 11(*b*) is an image related to analytical cross-sectional areas formed on respective portions in the volute 100 in order to perform the numerical analysis.

First, in a first step, a shape of the volute 100 may be determined, and a plurality of points may be formed inside and outside the volute 100. Specifically, in order to perform the numerical analysis, a plurality of inner points may be set in an inner circumferential direction of the volute 100. Likewise, in order to perform the numerical analysis, a plurality of outer points may be set in an outer circumferential direction of the volute 100.

Further, a channel cross-sectional shape of the spiral part 110 may be a rectangular shape having an edge portion curved toward the outside. Therefore, it is possible to increase a cubic meter per minute (CMM) and prevent clogging when the single-channel pump is used for wastewater. However, the channel cross-sectional shape of the spiral part 110 is not limited thereto. The channel cross-sectional shape of the spiral part 110 may be changed depending on the use of the single-channel pump of the present invention.

In a second step after the first step is performed, a target value, which is a value for a performance numerical value of the single-channel pump, may be selected, and a shape of the impeller 200 suitable for the target value may be determined. In this case, the target value may be an output of the single-channel pump. However, the target value may change to a head, efficiency, or the like.

Further, the shape of the impeller 200 suitable for the output of the pump may be changed even when a structural shape of the volute 100 is maintained. Therefore, the impeller 200 may be required to be replaced depending on the types of target values. After the target value is selected, the shape of the impeller 200 may be determined, and the numerical analysis may be performed on the single-channel pump of the present invention.

In a third step after the second step is performed, an analytical cross-sectional area, which is a channel cross-sectional area that adjoins inner and outer points on the volute 100, may be set, and a plurality of analytical cross-sectional areas may be formed for a plurality of portions in the volute 100.

Specifically, as illustrated in FIG. 11, the plurality of points is formed inside and outside the volute 100 in order to optimally design the volute 100, and one analytical cross-sectional area including one inner point and one outer point, which are adjacent to each other, may be formed.

Further, the inner points and the outer points are numbered. The plurality of analytical cross-sectional areas including the inner points and the outer points may be formed, such that the plurality of analytical cross-sectional areas may be formed in a flow direction of the fluid passing through the spiral part 110. In this case, one inner point and one outer point, which are included in one analytical cross-sectional area, may be positioned on an axis of the volute in a diameter direction.

In a fourth step after the third step is performed, a structure design variable, which is a structural variable of the single-channel pump, may be set, and the target value may be derived by the numerical analysis. In this case, the structure design variable may be a maximum diameter of the volute 100. Further, in addition to the preset structure design variable, other numerical values related to other structure may be preset on the basis of design diagrams in the related art.

The structure design variable may be arbitrarily set. However, the numerical analysis may be performed by performing the numerical analysis on the plurality of structure design variables and selecting a structure design variable that has the greatest effect on the result of the numerical analysis.

In this case, a finite volume method may be used to perform the numerical analysis. In the numerical analysis program, the computation is performed by setting variables such as the structure design variable, such that the target value is derived. The computation may be continuously performed until the target value satisfies a set target value, as shown in a fifth step.

In the fifth step after the fourth step is performed, a structure design variable value, which is a value of the structure design variable that allows the target value to satisfy the preset set target value, may be derived as design plan by performing the numerical analysis on the plurality of analytical cross-sectional areas.

Specifically, in case that the target value is derived in the fourth step as described above, the computation may be continuously performed in the numerical analysis program while changing the structure design variable, and the design analysis part equipped with the numerical analysis program may acquire values included in the set target value among the target values in accordance with the change in structure design variables and derive the structure design variable value for deriving the objective function value acquired as described above. In this case, the maximum diameter of the volute 100 may be derived as the structure design variable value.

On the basis of the optimization design result using the design method of the present invention, the structure design variable value may be changed by determining the shape of the impeller 200. Further, the target value may be changed by the change in structure design variable values.

As described above, the optimization design may be performed by changing the values of the structure design variables of the volute 100 depending on the types of impellers 200. In addition, as the structure design variable value is changed and the impeller 200 is changed, the performance of the single-channel pump of the present invention may be changed, and the target value or the like may be changed.

As described above, in order to perform the optimization design, the plurality of points is formed inside and outside the volute 100, and the analytical cross-sectional area including the adjacent inner and outer points is analyzed, such that the efficiency of the optimization design may be improved.

It is possible to manufacture the wastewater pump designed by the design method of the present invention.

Because the optimization design is performed on the single-channel pump as described above, it is possible to improve the performance of the single-channel pump and prevent the single channel from being clogged by a solidified material passing through the single channel.

Hereinafter, the analysis of the performance of the single-channel pump of the embodiment implemented by the derived structure design variable value and a single-channel pump of a comparative example will be described.

As illustrated in FIG. 11, the points may be set at Positions 1 to 13 outside the volute 100, and the inner points may be set at Positions 14 to 25 inside the volute 100. The analytical cross-sectional area including outer and inner points, which are most adjacent to each other, and used for the numerical analysis may be set at each of the positions.

In this case, the plurality of inner points and the plurality of outer points may be disposed in a rotation direction about a central axis of the volute 100. When the plurality of inner points and the plurality of outer points are disposed in the rotation direction as described above, and the plurality of inner points and the plurality of outer points may be disposed while defining a predetermined rotation angle. Therefore, it is possible to improve the reliability of the analysis using the analytical cross-sectional area by performing the analysis on the basis of a predetermined criteria for the entire volute 100.

[Numerical Analysis Technique]

The structure design variable values may be derived by each of the above-mentioned steps. In a specific embodiment, the structure design variable values were derived so that the target value was 4 kW and the target value was 5.5 kW. In this case, the structure design variable is the maximum diameter of the volute 100.

In this case, the structure design variable value was derived as 220 mm when the target value was 4 kW, and the structure design variable value was derived as 232 mm when the target value was 5.5 kW.

Therefore, the pump of the first embodiment of 4 kW grade and the pump of the second embodiment of 5.5 kW grade were derived. A pump of a first comparative example is a pump having a structure corresponding to the pump of the first embodiment but having a dimension made before the optimization design, and a pump of a second comparative example is a pump having a structure corresponding to the pump of the second embodiment but having a dimension made before the optimization design.

The following numerical analysis process was performed to perform the numerical analysis on the pump of the first embodiment, the pump of the second embodiment, the pump of the first comparative example, and the pump of the second comparative example.

In order to perform a steady-state RANS numerical analysis on a three-dimensional internal flow field, ANSYS CFX-19.1, which was commercially available software, was used, and governing equations discretized by a finite volume method (FVM) was used. In order to generate grids for flow domains of pump models of the embodiments and the comparative examples, Turbo-grid, ANSYS Meshing, and ICED-CFD were used, and boundary conditions for the analysis were performed by using CFX-Post.

Hexahedral grids were established for the respective configurations of the respective pumps. Water with 25 degrees Celsius was as a working fluid. A disc friction loss, a mechanical loss, and a leak loss were not included in numerical analysis results.

A stage-average method, which inputted flow values averaged in the circumferential direction through the boundary, was used for the boundary conditions. As a turbulence model, a scale adaptive simulation shear stress transport (SAS-SST) model, which showed accurate prediction for flow delamination and accurate analysis results in regions adjacent to wall surfaces, was used.

[Numerical Analysis Result]

In FIGS. 13 to 52, 4 kW 220 mm indicates the pump of the first embodiment, 4 kW Comparative indicates the pump of the first comparative example, 5.5 kW 232 mm indicates the pump of the second embodiment, and 5.5 kW Comparative indicates the pump of the second comparative example.

Further, hereinafter, for convenience of description, the angle of the volute 100 at the point, at which the smallest cross-sectional area is positioned among the cross-sectional areas of the inner channel of the volute 100, may be set to 0 degrees, and the angle of the volute 100 at the point, at which the largest cross-sectional area is positioned, may be set to 360 degrees.

Figure 13:
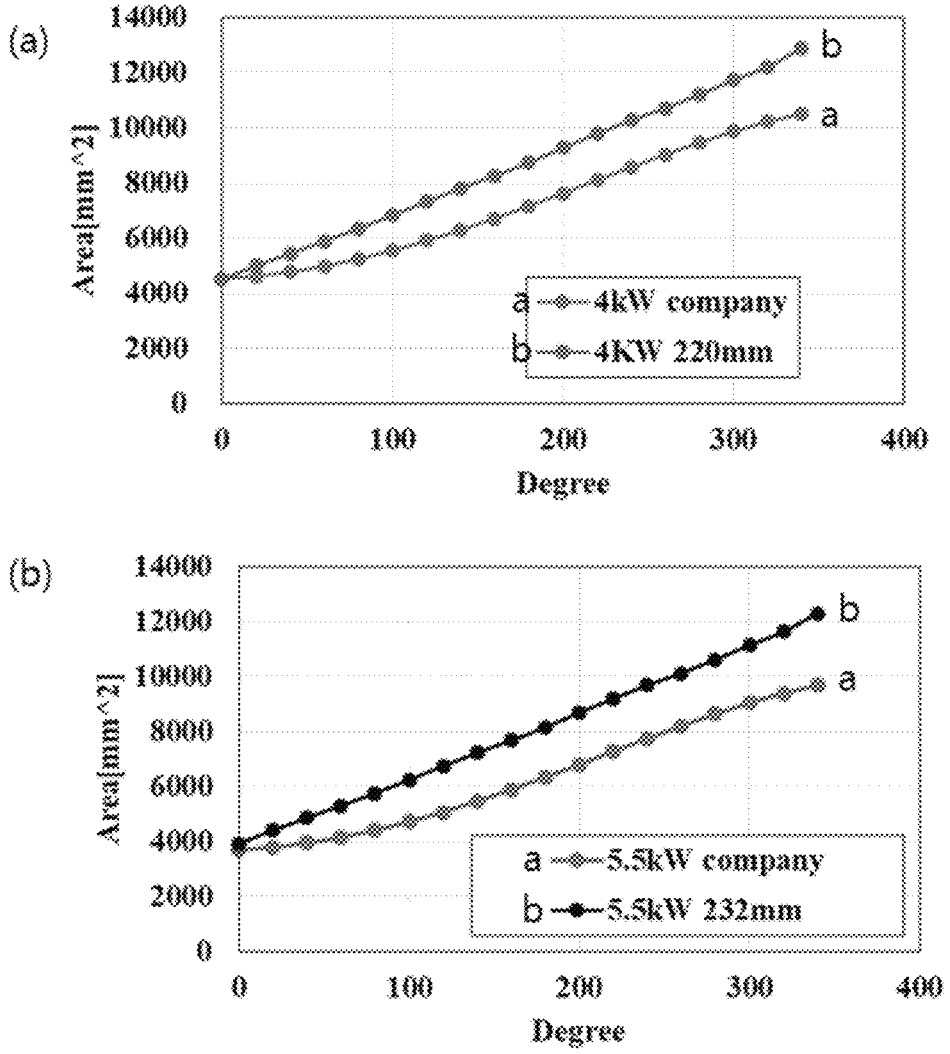
FIG. 13 is a graph showing channel cross-sectional areas of a single-channel pump according to the embodiment of the present invention and a single-channel pump of a comparative example.

FIG. 13 is a graph showing channel cross-sectional areas of the single-channel pump according to the embodiment of the present invention and the single-channel pump of the comparative example. FIG. 13(*a*) is a view related to the pump of the first embodiment and the pump of the first comparative example, and FIG. 13(*b*) is a view related to the pump of the second embodiment and the pump of the second comparative example.

As illustrated in FIG. 13, it can be ascertained that the channel cross-sectional area of each of the portions of the volute 100 of the pump of the first embodiment is larger than the channel cross-sectional area of each of the portions of the volute 100 of the pump of the first comparative example. Further, it can be ascertained that the channel cross-sectional area of each of the portions of the volute 100 of the pump of the second embodiment is larger than the channel cross-sectional area of each of the portions of the volute 100 of the pump of the second comparative example.

Therefore, it can be ascertained that the channel cross-sectional area of the pump according to the embodiment of the present invention is larger than the channel cross-sectional area of the pump of the comparative example made before the optimization design, and as a result, the clogging during the flow of the fluid may be reduced in the pump optimally designed by the design method of the present invention.

FIG. 14 is a table showing performance for each flow rate of the fluid passing through the single-channel pump according to the embodiment of the present invention.

Specifically, FIG. 14(*a*) illustrates the efficiency, total head (Ht), and torque in an a predetermined measuring plane (analytical cross-sectional area) inlet port (inlet to measuring plane) and the efficiency and total head (Ht) in the outlet port from the inlet port of the volute 100 for each cubic meter per minute Q (CMM) of the pump of the first embodiment.

Further, FIG. 14(*b*) illustrates the efficiency, total head (Ht), and torque in an a predetermined measuring plane (analytical cross-sectional area) inlet port (inlet to measuring plane) and the efficiency and total head (Ht) in the outlet port from the inlet port of the volute 100 for each cubic meter per minute Q (CMM) of the pump of the second embodiment.

As illustrated in FIG. 14(*a*), the pump of the first embodiment exhibits the best performance when Q is 1.4. As illustrated in FIG. 14(*b*), the pump of the second embodiment exhibits the best performance when Q is 1.8. In case that the design method of the present invention is used as described above, it is possible to obtain not only the structure design variable but also the information on the cubic meter per minute most suitable when the pump operates, such that the efficiency in using the single-channel pump may be improved.

Figure 15:
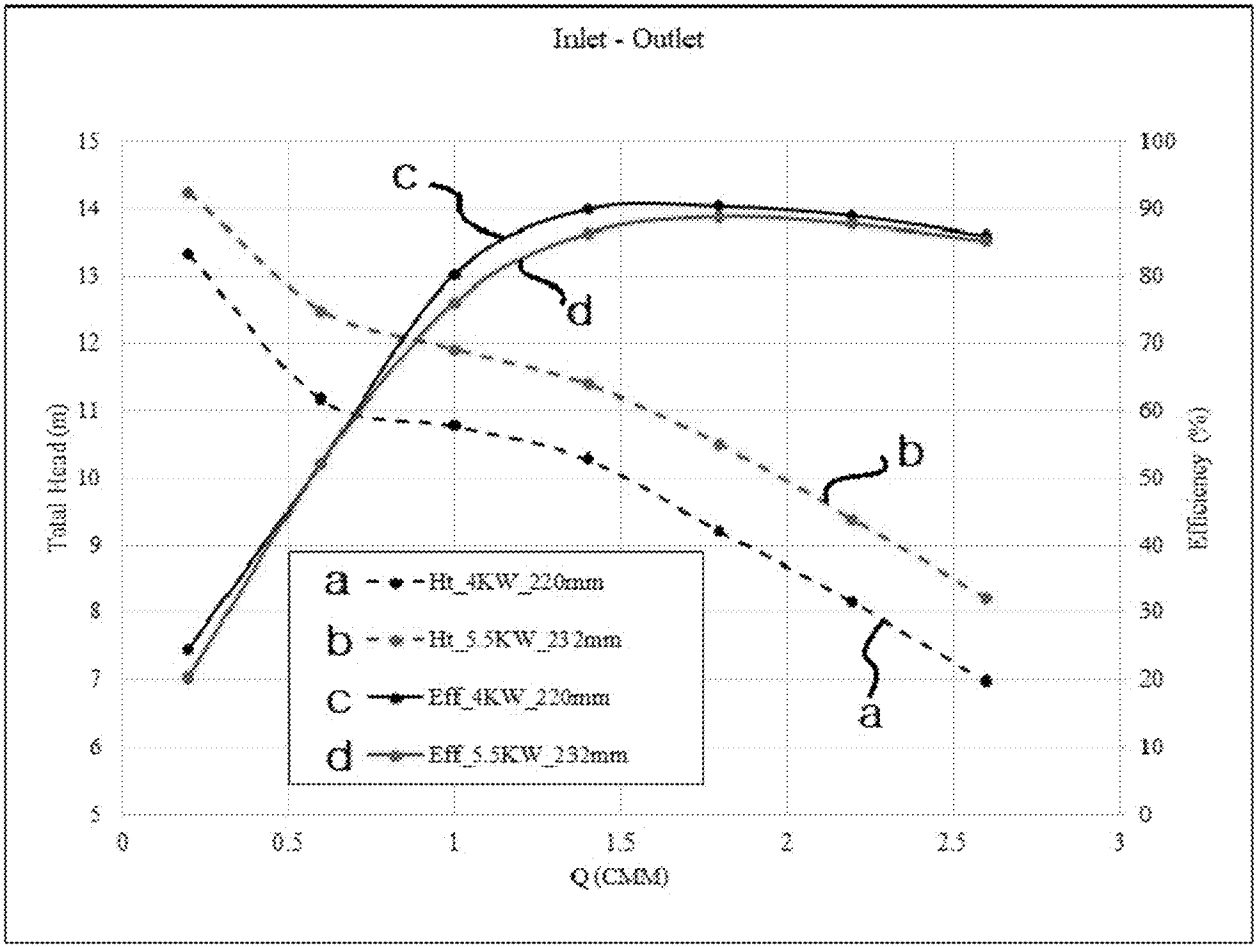
FIGS. 15 to 17 are graphs related to total heads, efficiency, outputs, and the like of the single-channel pump according to the embodiment of the present invention or the comparative example.
Figure 16:
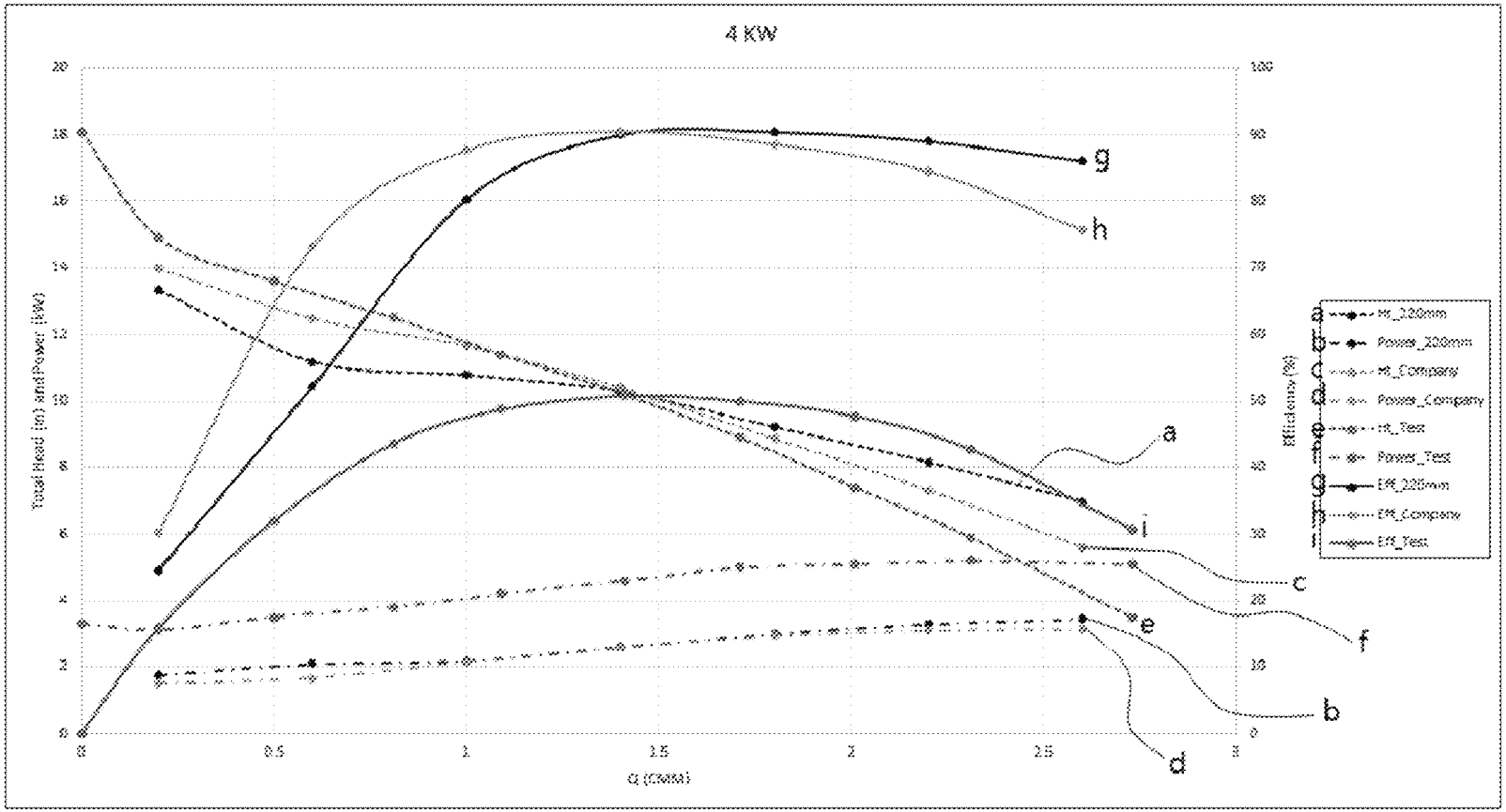
Figure 17:
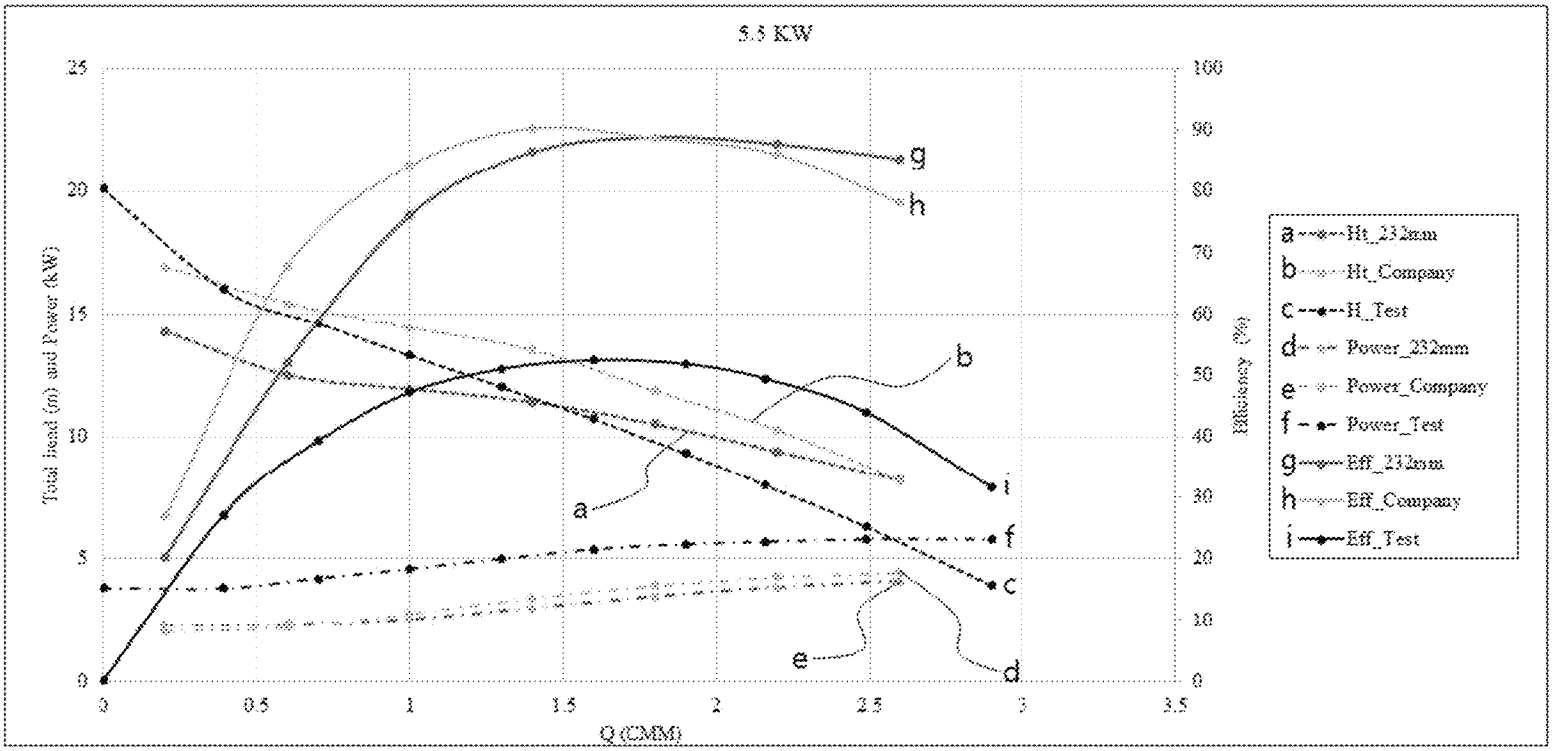

FIGS. 15 to 17 are graphs related to total heads, efficiency, outputs, and the like of the single-channel pump according to the embodiment of the present invention or the comparative example. In FIGS. 16 and 17, Test is shown in a graph made by data obtained by performing tests using a single-channel pump model for a test and may be excluded from the analysis.

FIG. 15 illustrates the cubic meter per minute Q (CMM) along the horizontal axis and illustrates the total head (Ht) and efficiency from the inlet port (Inlet) to the outlet port (Outlet) along the vertical axis in each of the pumps of the first and second embodiments.

As illustrated in FIG. 15, it can be ascertained that the efficiency of the pump of the first embodiment and the efficiency of the pump of the second embodiment are similar, and the total head of the pump of the second embodiment is higher than the total head of the pump of the first embodiment at the cubic meter per minute Q, such that the total head of the single-channel pump is adjusted by the design method of the present invention.

FIG. 16 illustrates the cubic meter per minute Q (CMM) along the horizontal axis and illustrates the total head (Ht), output (power), and efficiency of the pump (220 mm) of the first embodiment and the pump (comparative) of the first comparative example along the vertical axis.

Further, FIG. 17 illustrates the cubic meter per minute Q (CMM) along the horizontal axis and illustrates the total head (Ht), output (power), and efficiency of the pump (232 mm) of the second embodiment and the pump (comparative) of the second comparative example along the vertical axis.

As illustrated in FIG. 16, it can be ascertained that when the cubic meter per minute Q (CMM) is 1.5 or more so as to be suitable for the flow rate required for the sufficient operation of the single-channel pump, the performance of the pump of the first embodiment is better than the performance of the first comparative example in terms of the total head, output, and efficiency.

As illustrated in FIG. 17, it can be ascertained that when the cubic meter per minute Q (CMM) is 1.8 or more so as to be suitable for the flow rate required for the sufficient operation of the single-channel pump, the performance of the pump of the second embodiment is better than the performance of the second comparative example in terms of the total head, output, and efficiency.

Figure 18:
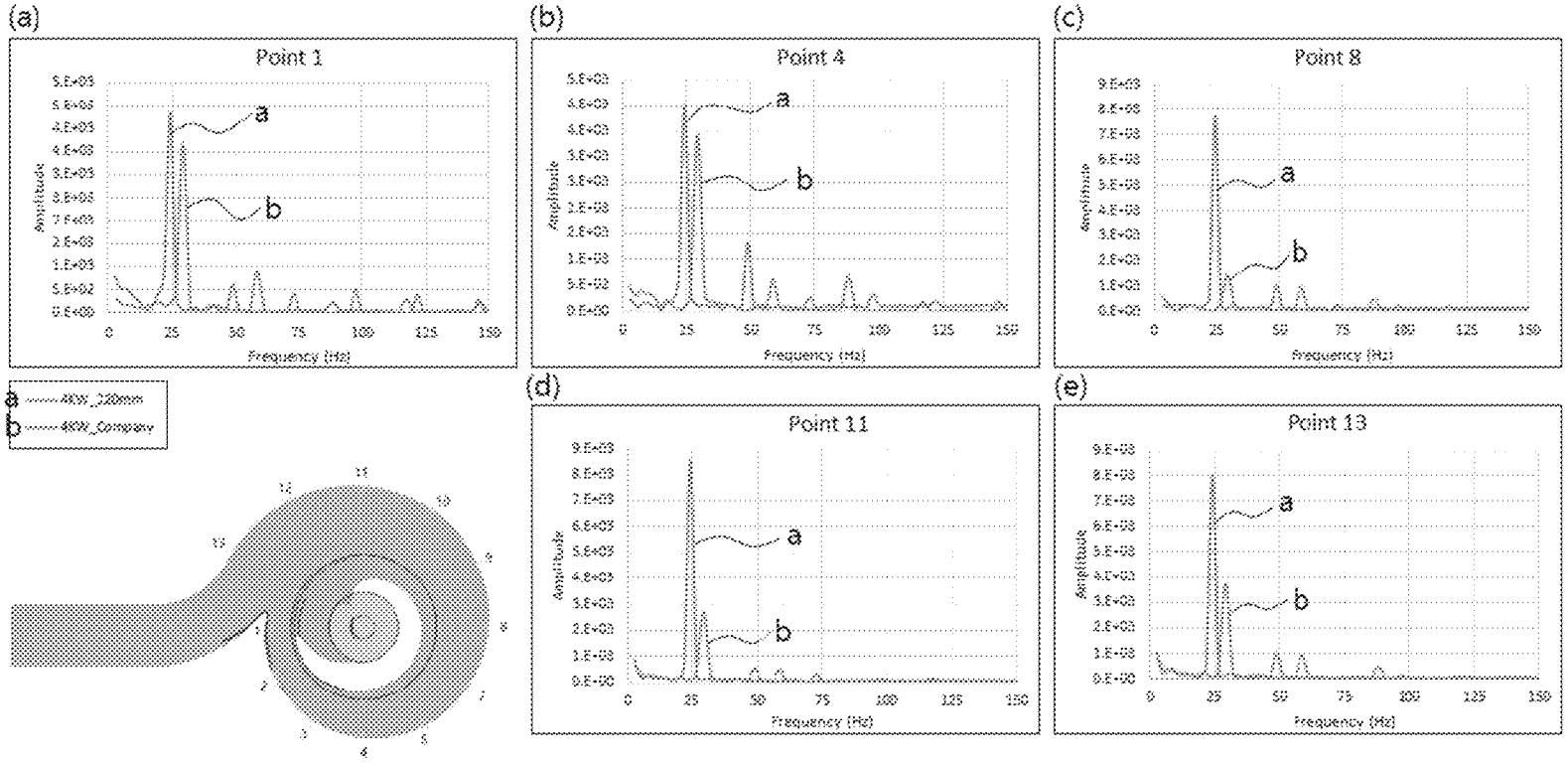
FIGS. 18 and 21 are graphs related to frequencies and amplitudes at respective points in the volute according to the embodiment of the present invention.
Figure 21:
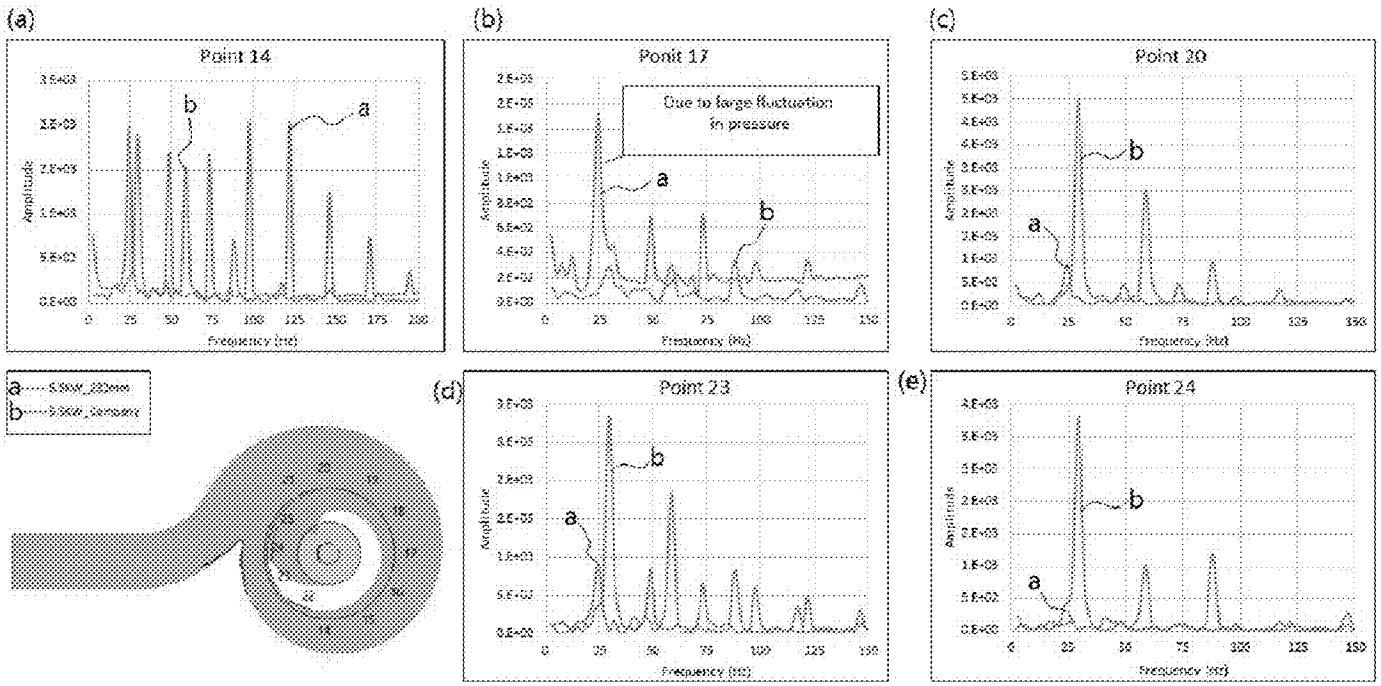

FIGS. 18 and 21 are graphs related to frequencies and amplitudes at respective points in the volute 100 according to the embodiment of the present invention.

FIGS. 18(*a*) to 18(*e*) are graphs illustrating changes in amplitudes at the outer points (Point 1, Point 4, Point 8, Point 11, and Point 13) for the volute 100 (4 kW_220 mm) of the first embodiment and the volute 100 (4 kW_Comparative) of the first comparative example when the impeller 200 rotates while changing frequencies (Hz).

Figure 19:
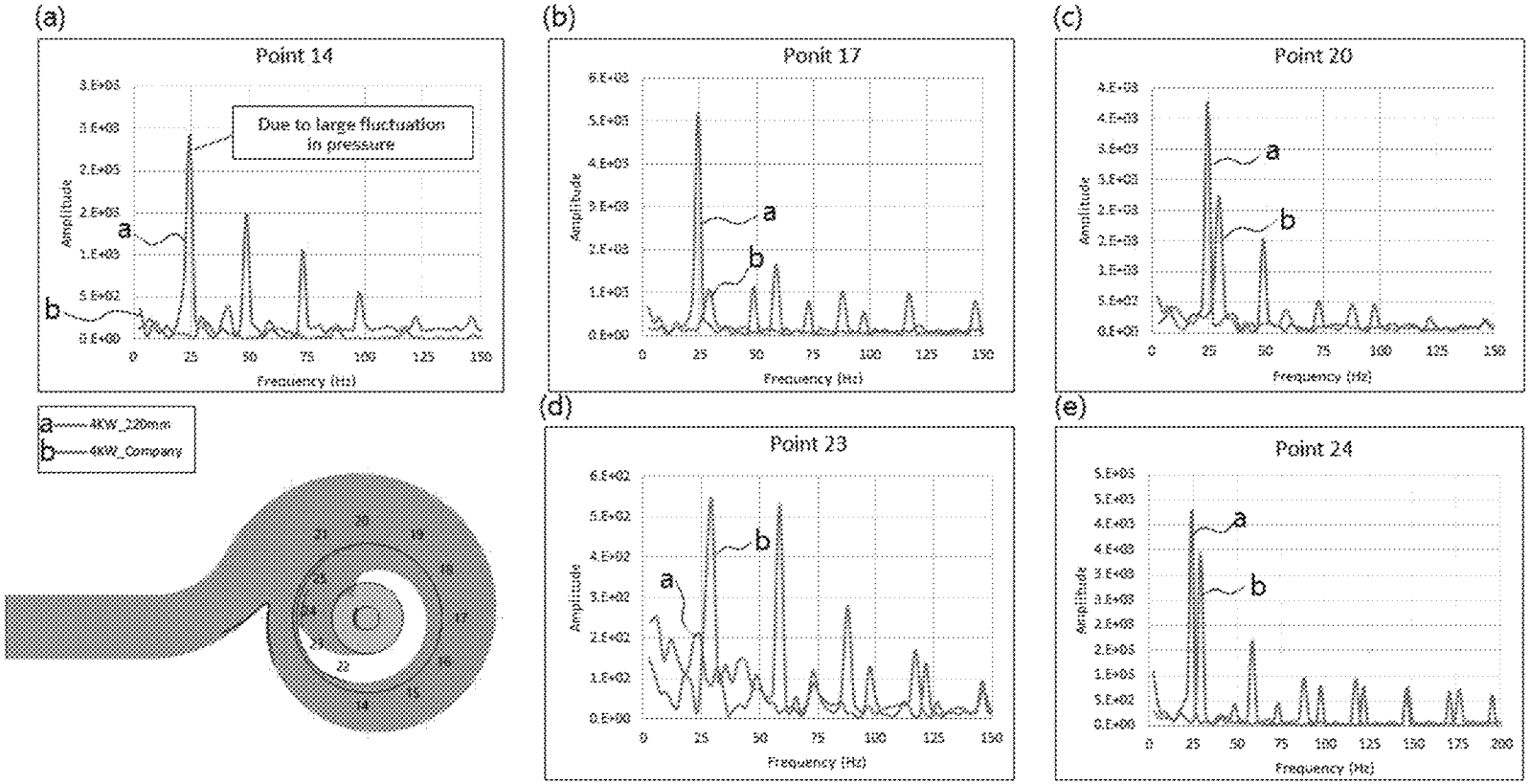

FIGS. 19(*a*) to 19(*e*) are graphs illustrating changes in amplitudes at the inner points (Point 14, Point 17, Point 20, Point 23, and Point 24) for the volute 100 (4 kW_220 mm) of the first embodiment and the volute 100 (4 kW_Comparative) of the first comparative example when the impeller 200 rotates while changing frequencies (Hz).

Figure 20:
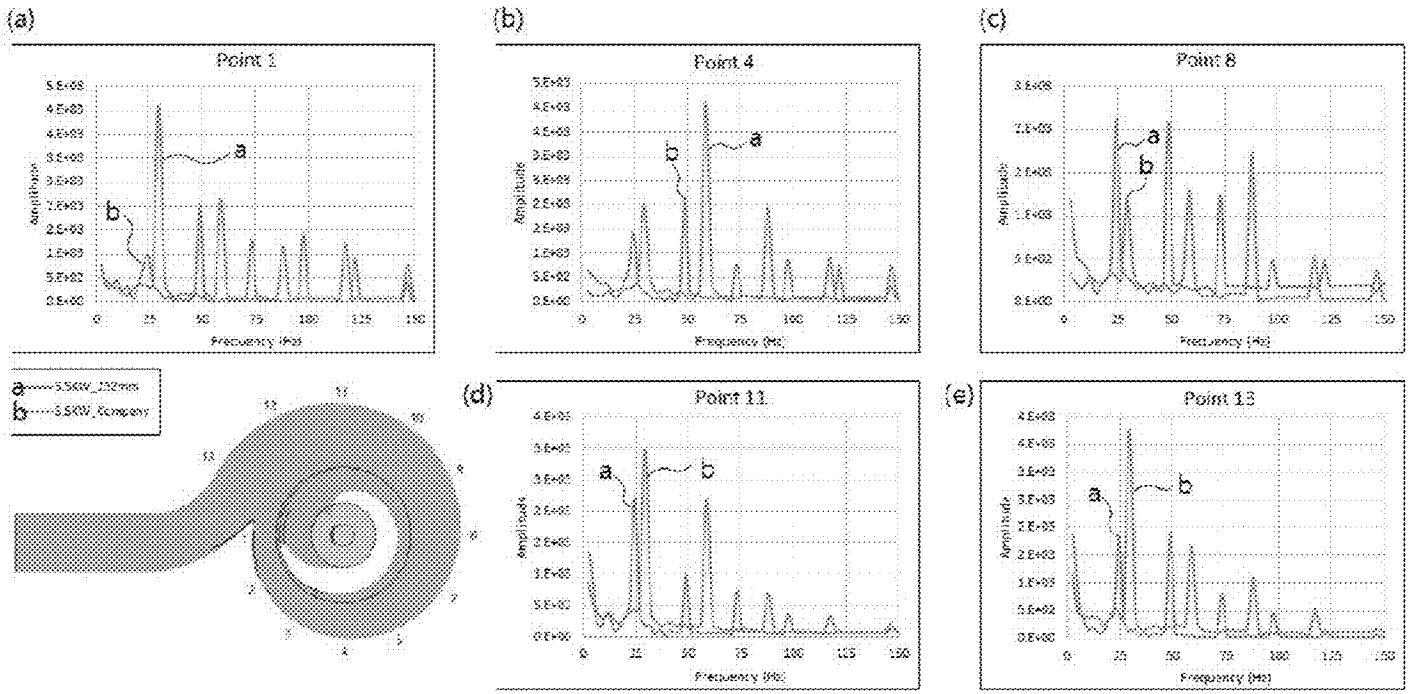

FIGS. 20(*a*) to 20(*e*) are graphs illustrating changes in amplitudes at the outer points (Point 1, Point 4, Point 8, Point 11, and Point 13) for the volute 100 (5.5 kW_232 mm) of the second embodiment and the volute 100 (5.5 kW_Comparative) of the second comparative example when the impeller 200 rotates while changing frequencies (Hz).

FIGS. 21(*a*) to 21(*e*) are graphs illustrating changes in amplitudes at the inner points (Point 14, Point 17, Point 20, Point 23, and Point 24) for the volute 100 (5.5 kW_232 mm) of the second embodiment and the volute 100 (5.5 kW_Comparative) of the second comparative example when the impeller 200 rotates while changing frequencies (Hz).

As illustrated in FIGS. 18 to 21, it can be ascertained that a higher peak of the amplitude is observed in the pump of the first comparative example in comparison with the pump of the first embodiment, a higher peak of the amplitude is observed in the pump of the second comparative example in comparison with the pump of the second embodiment, such that the vibration is relatively decreased in the pump of the first embodiment and the pump of the second embodiment, and as a result, the low vibration is implemented when the single-channel pump of the present invention is used.

Figure 22:
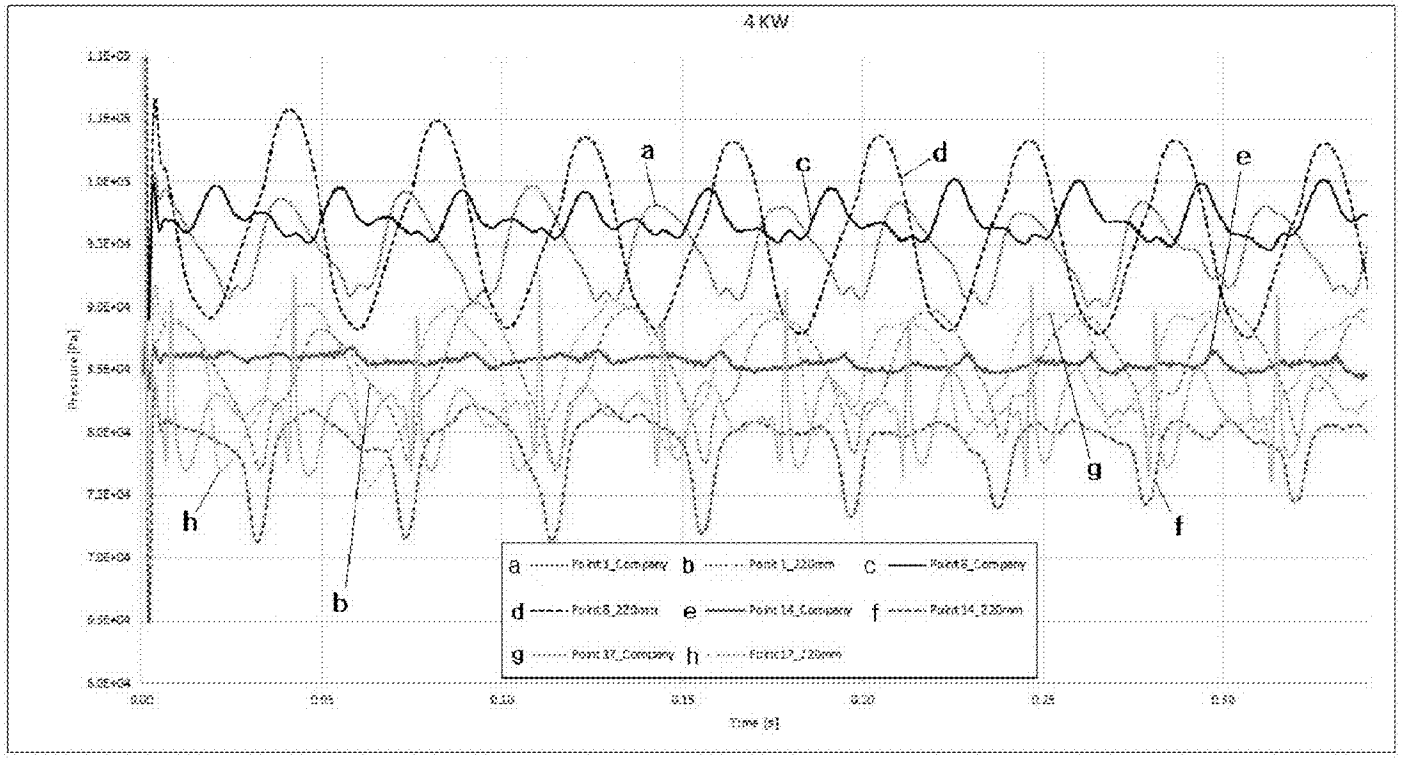
FIGS. 22 to 24 are graphs related to pressures at respective portions in the volute according to the embodiment of the present invention.
Figure 23:
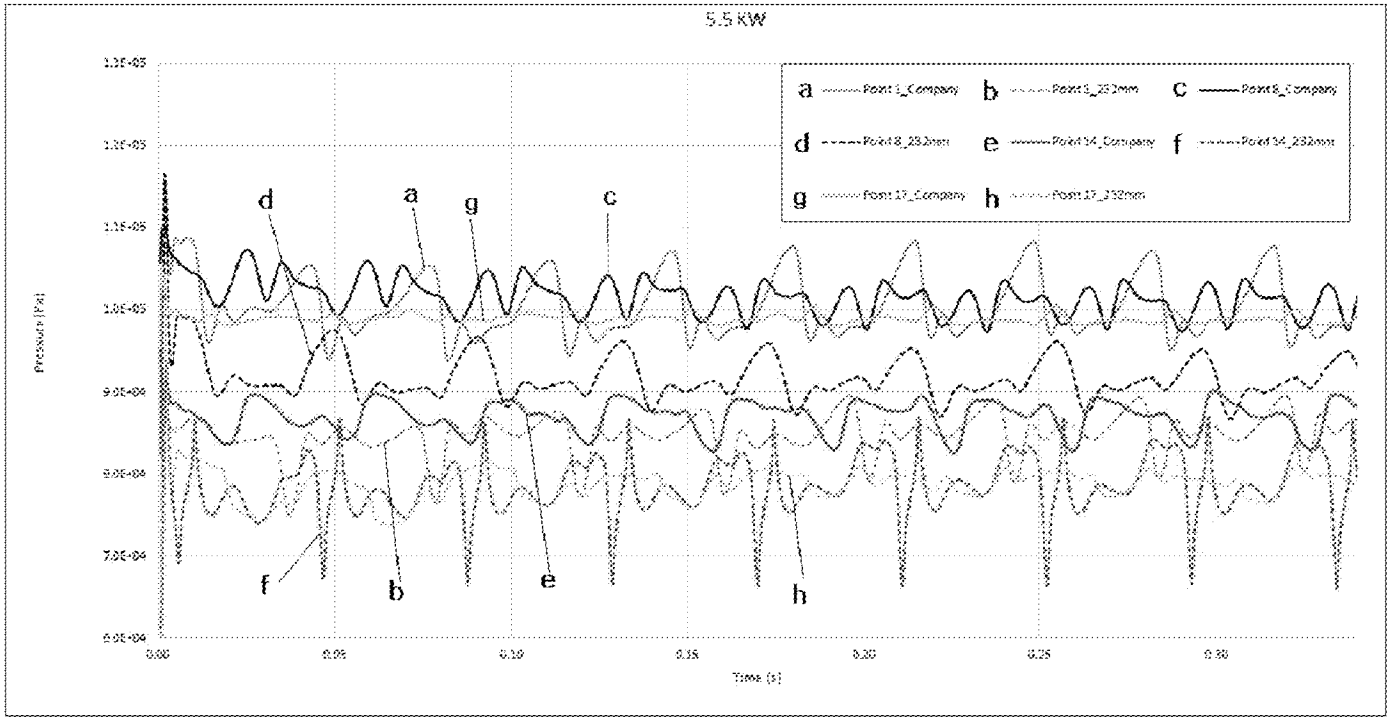
Figure 24:
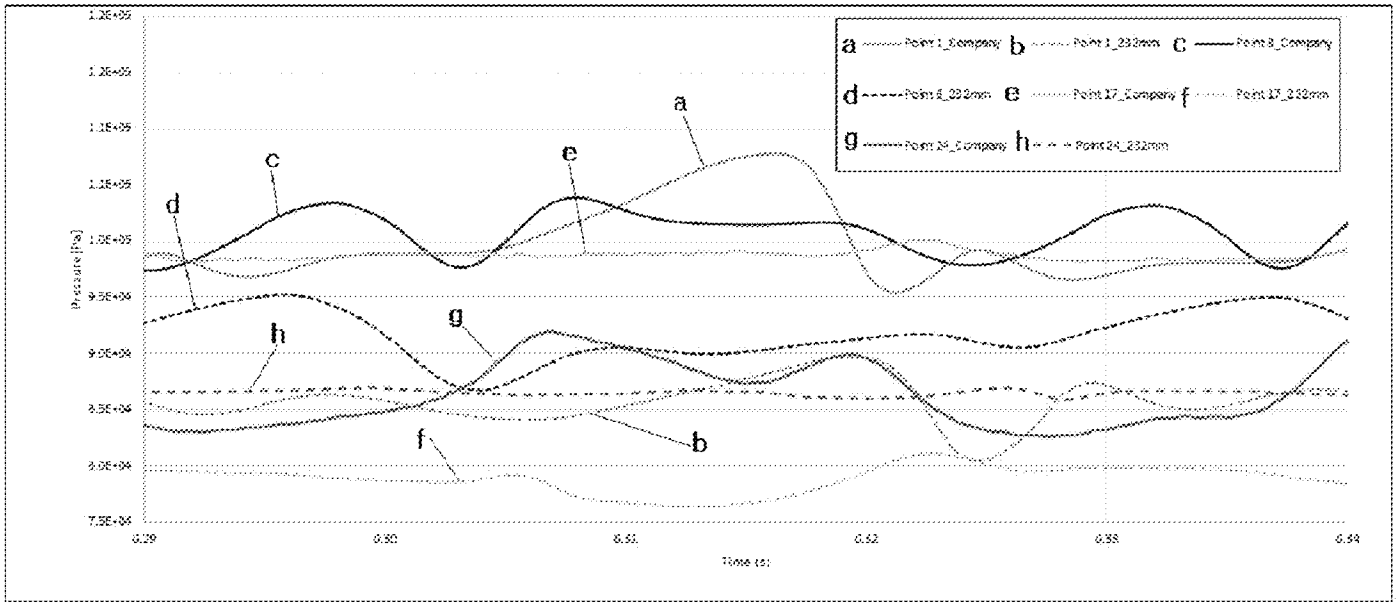

FIGS. 22 to 24 are graphs related to pressures at respective portions in the volute 100 according to the embodiment of the present invention.

Specifically, FIG. 22 is a graph illustrating pressures with respect to time at the respective points (Point 1, Point 8, Point 14, and Point 17) of the pump (220 mm) of the first embodiment and the respective points (Point 1, Point 8, Point 14, and Point 17) of the pump (Comparative) of the first comparative example.

In addition, FIG. 23 is a graph illustrating pressures with respect to time at the respective points (Point 1, Point 8, Point 14, and Point 17) of the pump (232 mm) of the second embodiment and the respective points (Point 1, Point 8, Point 14, and Point 17) of the pump (Comparative) of the second comparative example. Further, FIG. 24 is an enlarged view of a partial section in FIG. 23.

As illustrated in FIGS. 22 to 24, it can be ascertained that a relatively large pressure fluctuation occurs at Point 8 and Point 17 in the pump of the first embodiment and the pump of the second embodiment, and a relatively large pressure fluctuation occurs at Point 1 and Point 24 in the pump of the first comparative example and the pump in the second comparative example.

Therefore, it can be ascertained that in the pump of the first embodiment and the pump of the second embodiment, a relatively large pressure fluctuation occurs on the portions with a relatively larger cross-sectional flow area, such that the occurrence of vibration is relatively reduced.

Figure 25:
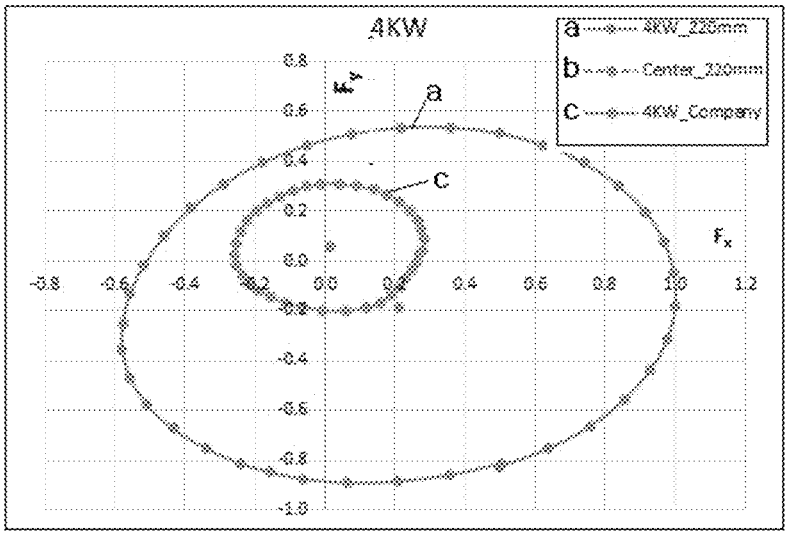
FIGS. 25 and 26 are graphs related to the distribution of diametral forces in the single-channel pump of the embodiment of the present invention or the comparative example.
Figure 25:
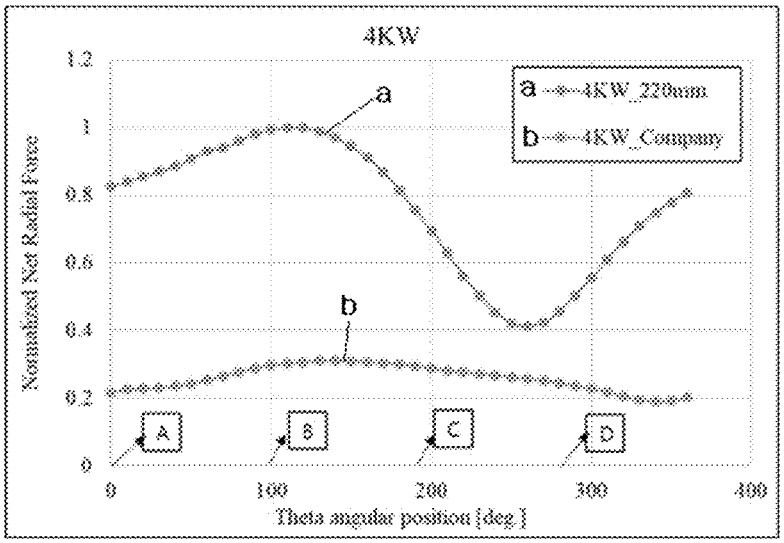
Figure 26:
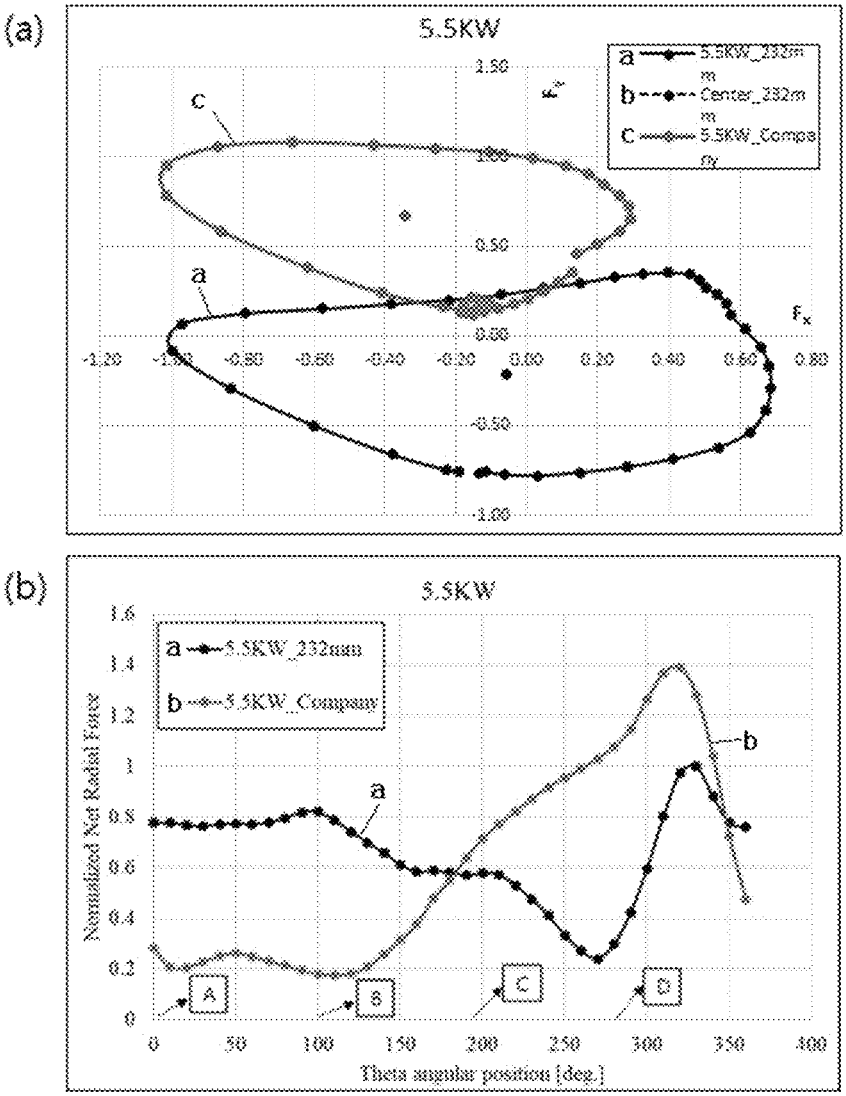

FIGS. 25 and 26 are graphs related to the distribution of diametral forces in the single-channel pump of the embodiment of the present invention or the comparative example.

FIG. 25 is a graph related to the pump (4 kW_220 mm) of the first embodiment and the pump (4 kW_Comparative) of the first comparative example, in which FIG. 25 (*a*) is a graph related to the distribution of forces applied to the fluid in the x-axis and y-axis directions from the center of the rotation axis of the impeller 200, and FIG. 25(*b*) is a graph related to the change in diametral forces at the angular positions in the volute 100.

Further, FIG. 26 is a graph related to the pump (5.5 kW_232 mm) of the second embodiment and the pump (5.5 kW_Comparative) of the second comparative example, in which FIG. 26(*a*) is a graph related to the distribution of forces applied to the fluid in the x-axis and y-axis directions from the center of the rotation axis of the impeller 200, and FIG. 26(*b*) is a graph related to the change in diametral forces at the angular positions in the volute 100.

As illustrated in FIGS. 25 and 26, in comparison with the pump of the first comparative example, the distribution of forces applied to the fluid in the x-axis and y-axis directions is larger in the pump of the first embodiment, and the force in the diameter direction is higher. Further, it can be ascertained that in comparison with the pump of the first comparative example, the distribution of forces applied to the fluid in the x-axis and y-axis directions is larger in the pump of the first embodiment, and the force in the diameter direction is higher at a position of 180 degrees or more in the volute 100. Therefore, it can be ascertained that in the pump of the first embodiment and the pump of the second embodiment, the forces applied to the fluids are relatively increased, and the efficiency of the single-channel pump of the present invention is improved.

FIGS. 27 to 30 are images illustrating pressures, TKE, flow directions, and flow velocities in the volute 100 of the embodiment of the present invention or the comparative example. In FIGS. 27 to 30, TKE represents turbulence kinetic energy. The same for TKE is applicable to other drawings.

Figure 27:
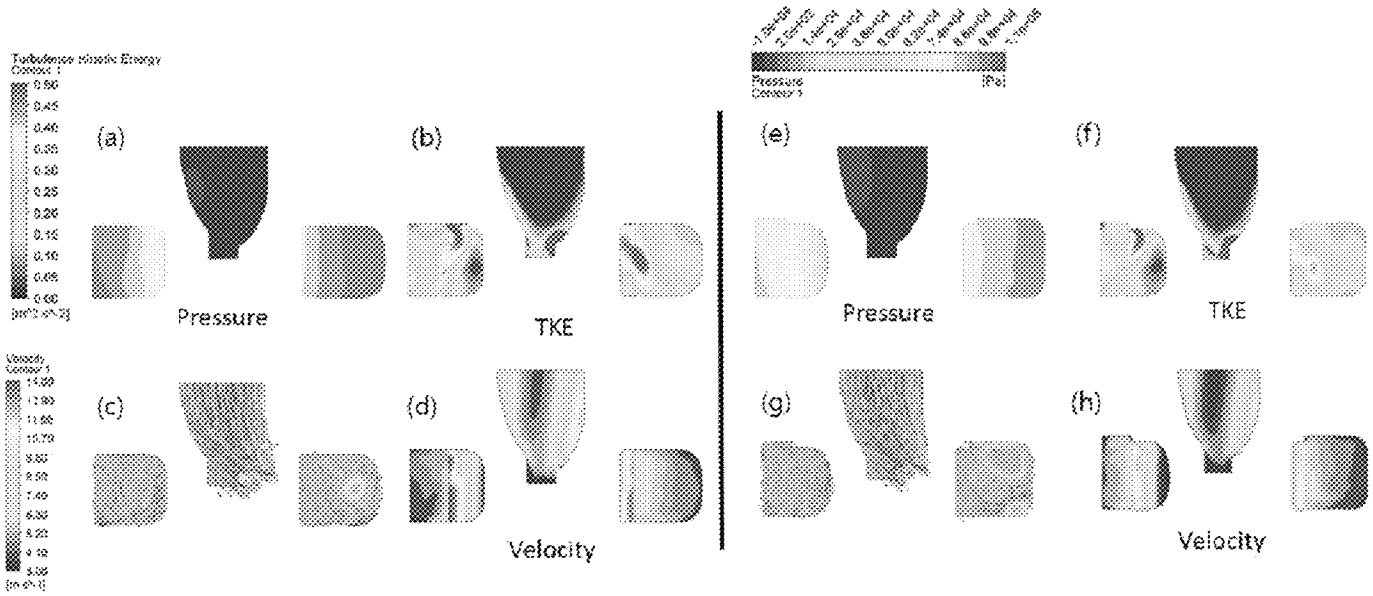
FIGS. 27 to 30 are images illustrating pressures, TKE, flow directions, and flow velocities in the volute of the embodiment of the present invention or the comparative example.

FIGS. 27(*a*) to 27(*d*) are views related to the pumps of the second comparative example, in which in the analytical cross-sectional area at the position of Point 14, the analytical cross-sectional area at the position of Point 20, and the inlet pipe 130 when the inlet port of the impeller 200 is positioned at the position of Point 14 in the volute 100, FIG. 27(*a*) illustrates the pressure distribution of the fluid, FIG. 27(*b*) illustrates the TKE distribution of the fluid, FIG. 27(*c*) illustrates the flow line distribution of the fluid, and FIG. 27(*d*) illustrates the flow velocity distribution of the fluid.

FIGS. 27(*e*) to 27(*h*) are views related to the pumps of the second embodiment, in which in the analytical cross-sectional area at the position of Point 14, the analytical cross-sectional area at the position of Point 20, and the inlet pipe 130 when the inlet port of the impeller 200 is positioned at the position of Point 14 in the volute 100, FIG. 27(*e*) illustrates the pressure distribution of the fluid, FIG. 27(*f*) illustrates the TKE distribution of the fluid, FIG. 27(*g*) illustrates the flow line distribution of the fluid, and FIG. 27(*h*) illustrates the flow velocity distribution of the fluid.

Figure 28:
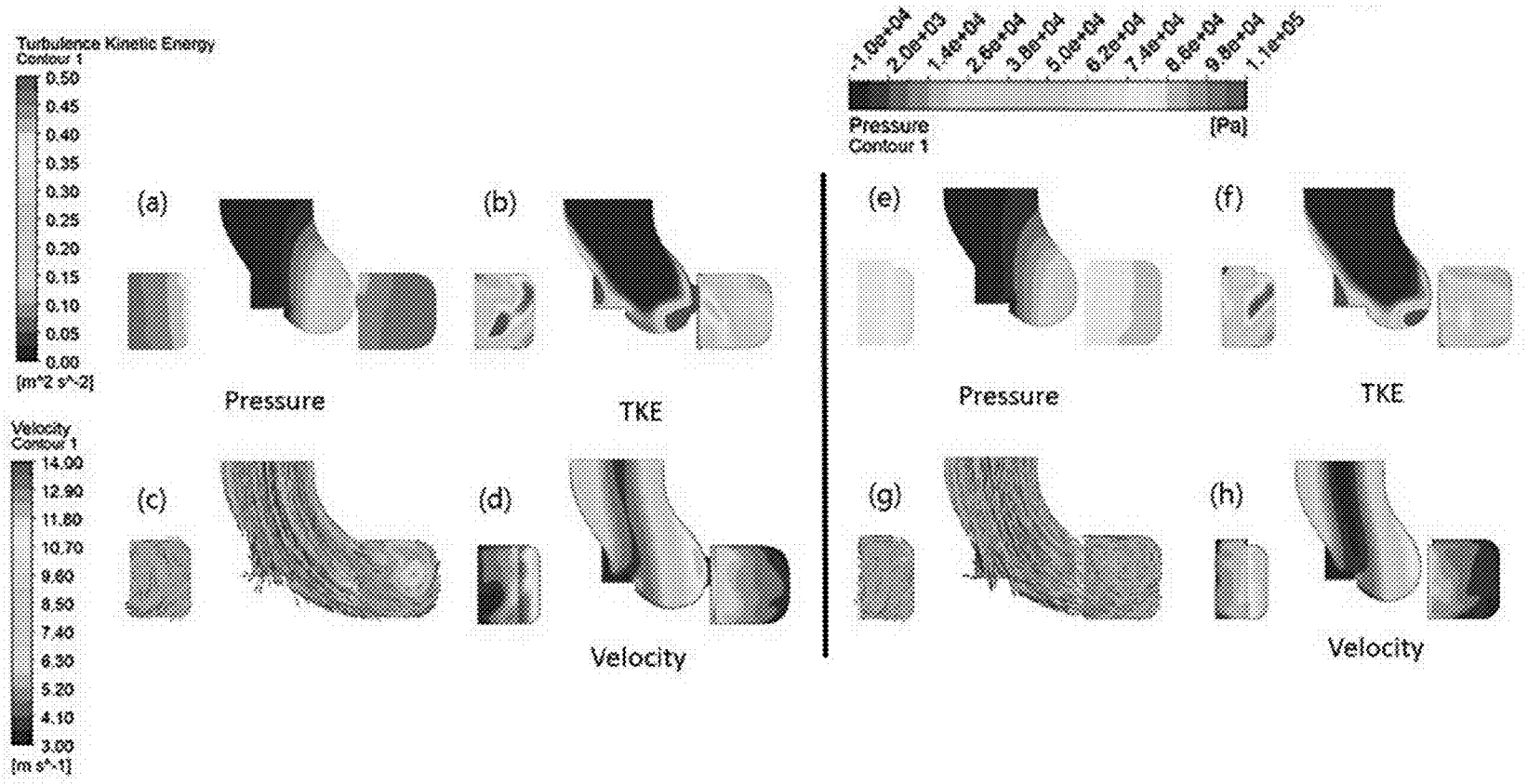

FIGS. 28(*a*) to 28(*d*) are views related to the pumps of the second comparative example, in which in the analytical cross-sectional area at the position of Point 17, the analytical cross-sectional area at the position of Point 24, and the inlet pipe 130 when the inlet port of the impeller 200 is positioned at the position of Point 17 in the volute 100, FIG. 28(*a*) illustrates the pressure distribution of the fluid, FIG. 28(*b*)

illustrates the TKE distribution of the fluid, FIG. 28(*c*) illustrates the flow line distribution of the fluid, and FIG. 28(*d*) illustrates the flow velocity distribution of the fluid.

FIGS. 28(*e*) to 28(*h*) are views related to the pumps of the second embodiment, in which in the analytical cross-sectional area at the position of Point 17, the analytical cross-sectional area at the position of Point 24, and the inlet pipe 130 when the inlet port of the impeller 200 is positioned at the position of Point 17 in the volute 100, FIG. 28(*e*) illustrates the pressure distribution of the fluid, FIG. 28(*f*) illustrates the TKE distribution of the fluid, FIG. 28(*g*) illustrates the flow line distribution of the fluid, and FIG. 28(*h*) illustrates the flow velocity distribution of the fluid.

Figure 29:
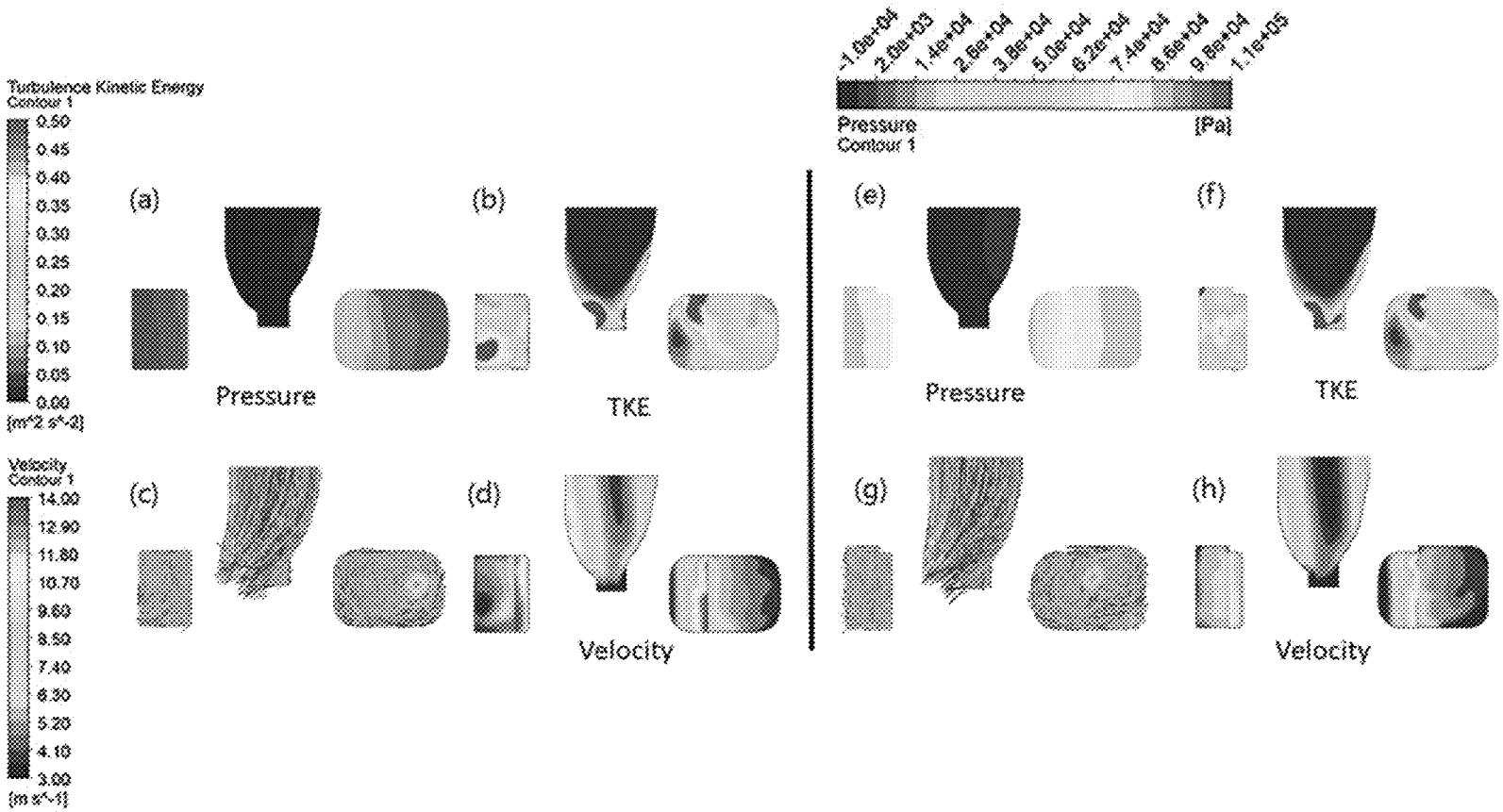

FIGS. 29(*a*) to 29(*d*) are views related to the pumps of the second comparative example, in which in the analytical cross-sectional area at the position of Point 20, the analytical cross-sectional area at the position of Point 14, and the inlet pipe 130 when the inlet port of the impeller 200 is positioned at the position of Point 20 in the volute 100, FIG. 29(*a*) illustrates the pressure distribution of the fluid, FIG. 29(*b*) illustrates the TKE distribution of the fluid, FIG. 29(*c*) illustrates the flow line distribution of the fluid, and FIG. 29(*d*) illustrates the flow velocity distribution of the fluid.

FIGS. 29(*e*) to 29(*h*) are views related to the pumps of the second embodiment, in which in the analytical cross-sectional area at the position of Point 20, the analytical cross-sectional area at the position of Point 14, and the inlet pipe 130 when the inlet port of the impeller 200 is positioned at the position of Point 20 in the volute 100, FIG. 29(*e*) illustrates the pressure distribution of the fluid, FIG. 29(*f*) illustrates the TKE distribution of the fluid, FIG. 29(*g*) illustrates the flow line distribution of the fluid, and FIG. 29(*h*) illustrates the flow velocity distribution of the fluid.

Figure 30:
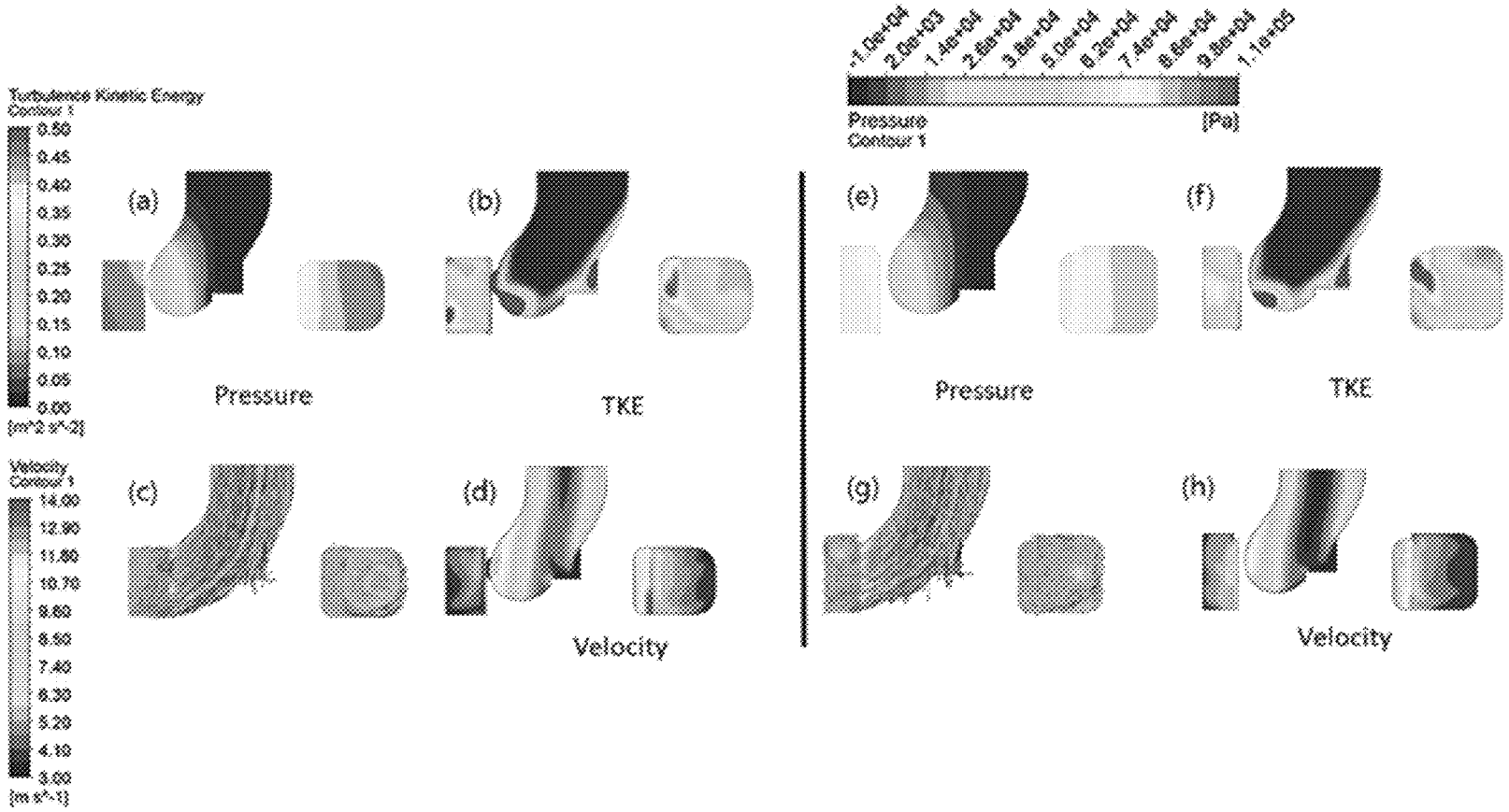

FIGS. 30(*a*) to 30(*d*) are views related to the pumps of the second comparative example, in which in the analytical cross-sectional area at the position of Point 17, the analytical cross-sectional area at the position of Point 24, and the inlet pipe 130 when the inlet port of the impeller 200 is positioned at the position of Point 24 in the volute 100, FIG. 30(*a*) illustrates the pressure distribution of the fluid, FIG. 30(*b*) illustrates the TKE distribution of the fluid, FIG. 30(*c*) illustrates the flow line distribution of the fluid, and FIG. 30(*d*) illustrates the flow velocity distribution of the fluid.

FIGS. 30(*e*) to 30(*h*) are views related to the pumps of the second embodiment, in which in the analytical cross-sectional area at the position of Point 17, the analytical cross-sectional area at the position of Point 24, and the inlet pipe 130 when the inlet port of the impeller 200 is positioned at the position of Point 24 in the volute 100, FIG. 30(*e*) illustrates the pressure distribution of the fluid, FIG. 30(*f*) illustrates the TKE distribution of the fluid, FIG. 30(*g*) illustrates the flow line distribution of the fluid, and FIG. 30(*h*) illustrates the flow velocity distribution of the fluid.

With reference to the comparison between (a) and (e) in FIGS. 27 to 30, it can be ascertained that in comparison with the pump of the second comparative example, the pressure deviation is small, and the low vibration is implemented in the pump of the second embodiment.

In addition, with reference to the comparison between (b) and (f) in FIGS. 27 to 30, it can be ascertained that in comparison with the pump of the second comparative example, the TKE deviation is small, and the low vibration is implemented in the pump of the second embodiment.

In addition, with reference to the comparison between (c) and (g) in FIGS. 27 to 30, in comparison with the pump in the second comparative example, the flow line distribution of the fluid is uniformly formed, and the low vibration is implemented in the pump of the second embodiment.

Further, with reference to the comparison between (d) and (h) in FIGS. 27 to 30, it can be ascertained that in comparison with the pump of the second comparative example, the flow velocity deviation is small, and the low vibration is implemented in the pump of the second embodiment.

FIGS. 31 to 40 are images related to physical properties of a fluid flowing in the volute 100 of the embodiment of the present invention or the comparative example.

Figure 31:
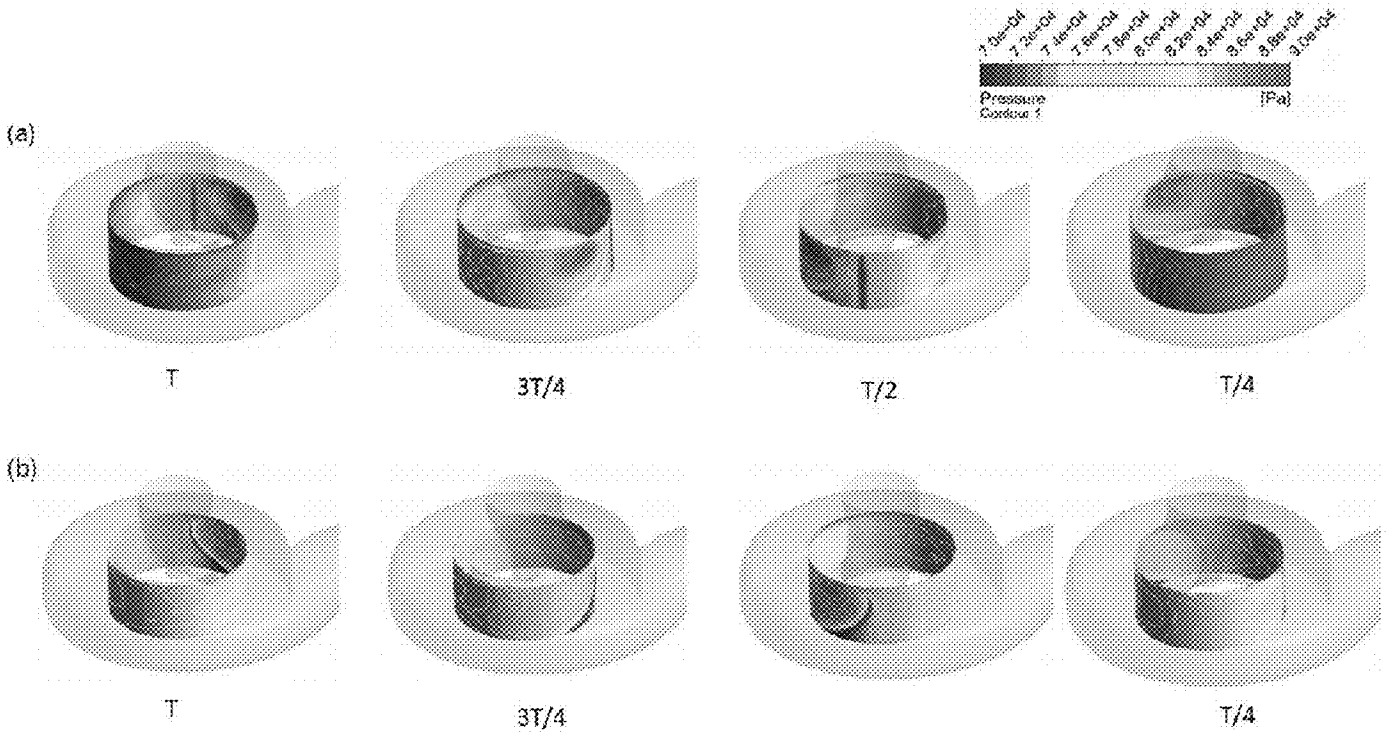
FIGS. 31 to 40 are images related to physical properties of a fluid flowing in the volute of the embodiment of the present invention or the comparative example.

FIG. 31(*a*) is a view related to the pump of the first embodiment and illustrates the pressure distribution in the volute 100 over time in accordance with the rotation of the impeller 200. In this case, T represents time, and T may be 1 seconds. The same applies to the following description. Further, FIG. 31(*b*) is a view related to the pump of the first comparative example and illustrates the pressure distribution in the volute 100 over time in accordance with the rotation of the impeller 200.

Figure 32:
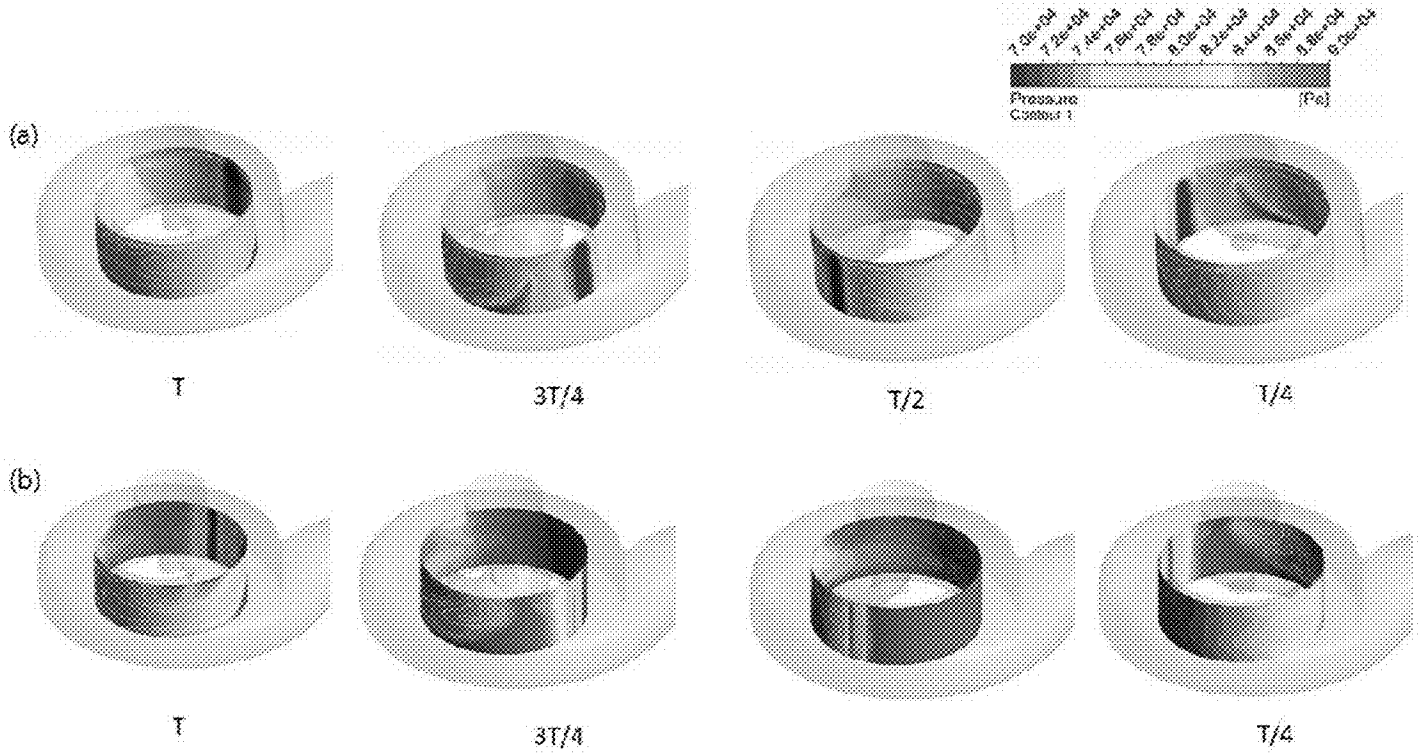

FIG. 32(*a*) is a view related to the pump of the second embodiment and illustrates the pressure distribution in the volute 100 over time in accordance with the rotation of the impeller 200. Further, FIG. 32(*b*) is a view related to the pump of the second comparative example and illustrates the pressure distribution in the volute 100 over time in accordance with the rotation of the impeller 200.

Figure 33:
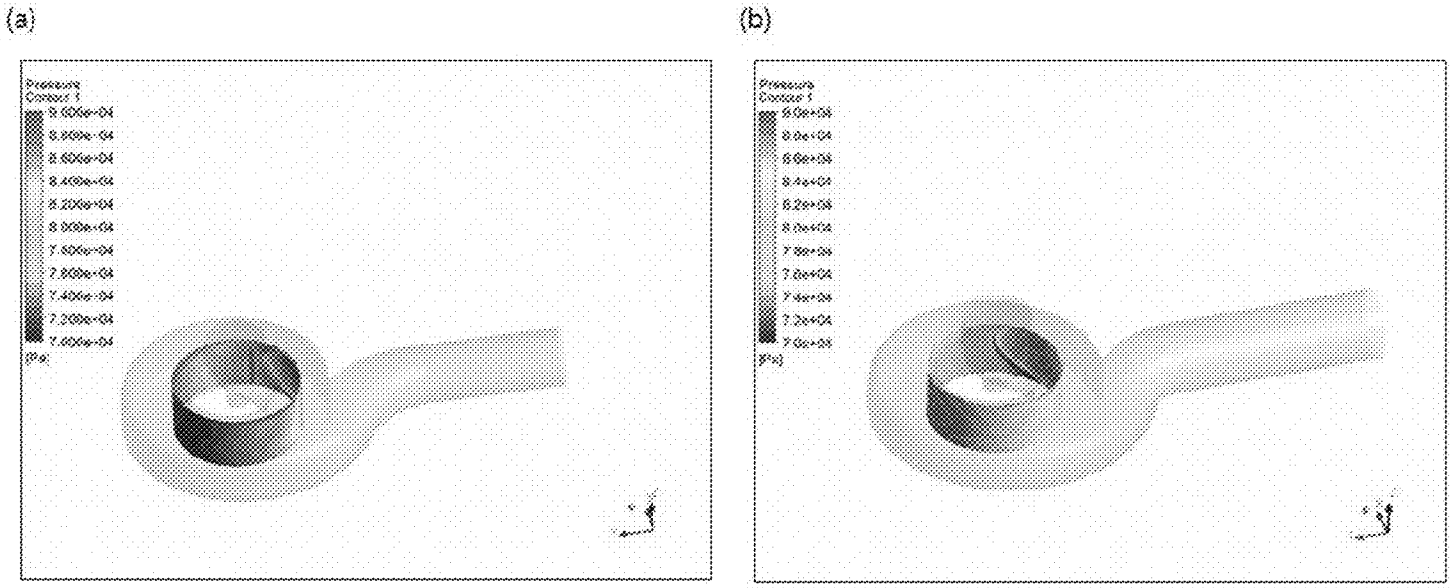

FIGS. 33(*a*) and (*b*) are views related to the pressure distribution in the volute 100 at the same instant, in which FIG. 33(*a*) is a view related to the pump of the first embodiment, and FIG. 33(*b*) is a view related to the pump of the first comparative example.

Figure 34:
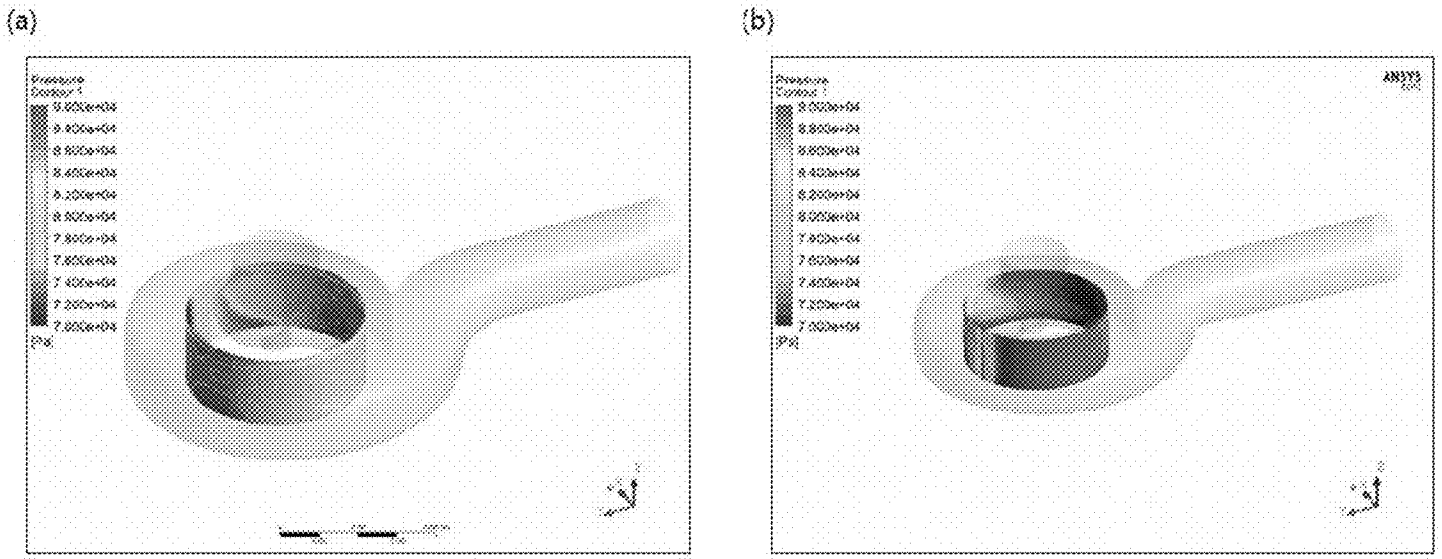

Further, FIGS. 34(*a*) and (*b*) are views related to the pressure distribution in the volute 100 at the same instant, in which FIG. 34(*a*) is a view related to the pump of the second embodiment, and FIG. 34(*b*) is a view related to the pump of the first comparative example.

As illustrated in FIGS. 31 to 34, it can be ascertained that in comparison with the pumps of the comparative examples, the pressure deviation is small, and the average pressure is lower in the pumps of the embodiments. Therefore, it can be ascertained that the low vibration is implemented in the single-channel pump of the present invention optimally designed by using the design method of the present invention.

Figure 35:
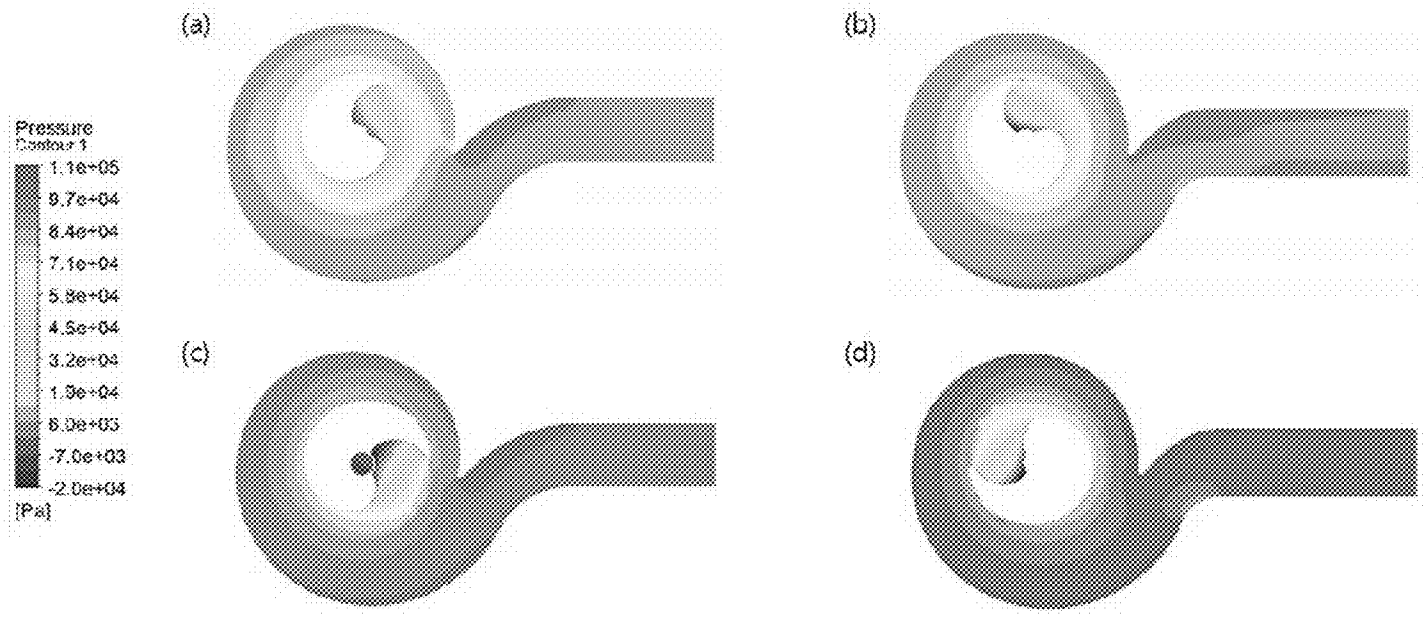

FIG. 35 is a view related to the fluid pressure distribution in the volute 100, in which FIG. 35(*a*) is a view related to the pump of the first embodiment, FIG. 35(*b*) is a view related to the pump of the first comparative example, FIG. 35(*c*) is a view related to the pump of the second embodiment, and FIG. 35(*d*) is a view related to the pump of the second comparative example.

Figure 36:
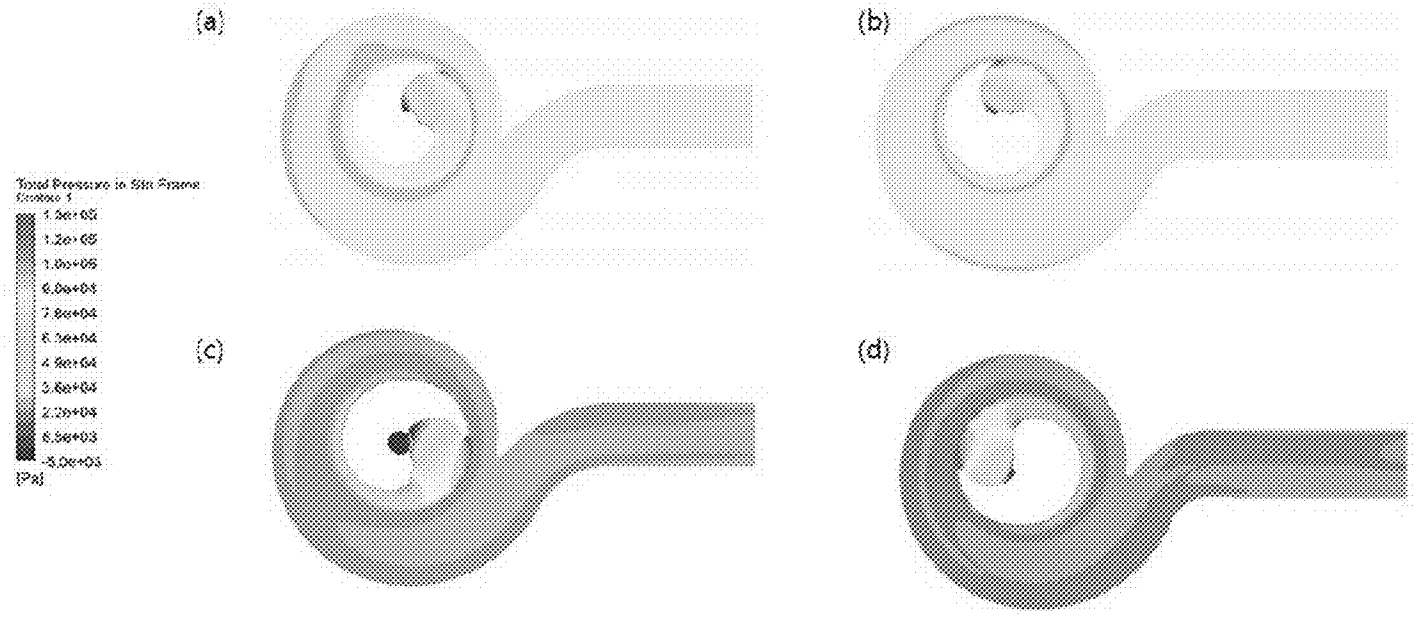

FIG. 36 is a view related to the distribution of the total pressure in Stn frame of the fluid in the volute 100, in which FIG. 36(*a*) is a view related to the pump of the first embodiment, FIG. 36(*b*) is a view related to the pump of the first comparative example, FIG. 36(*c*) is a view related to the pump of the second embodiment, and FIG. 36(*d*) is a view related to the pump of the second comparative example.

Figure 37:
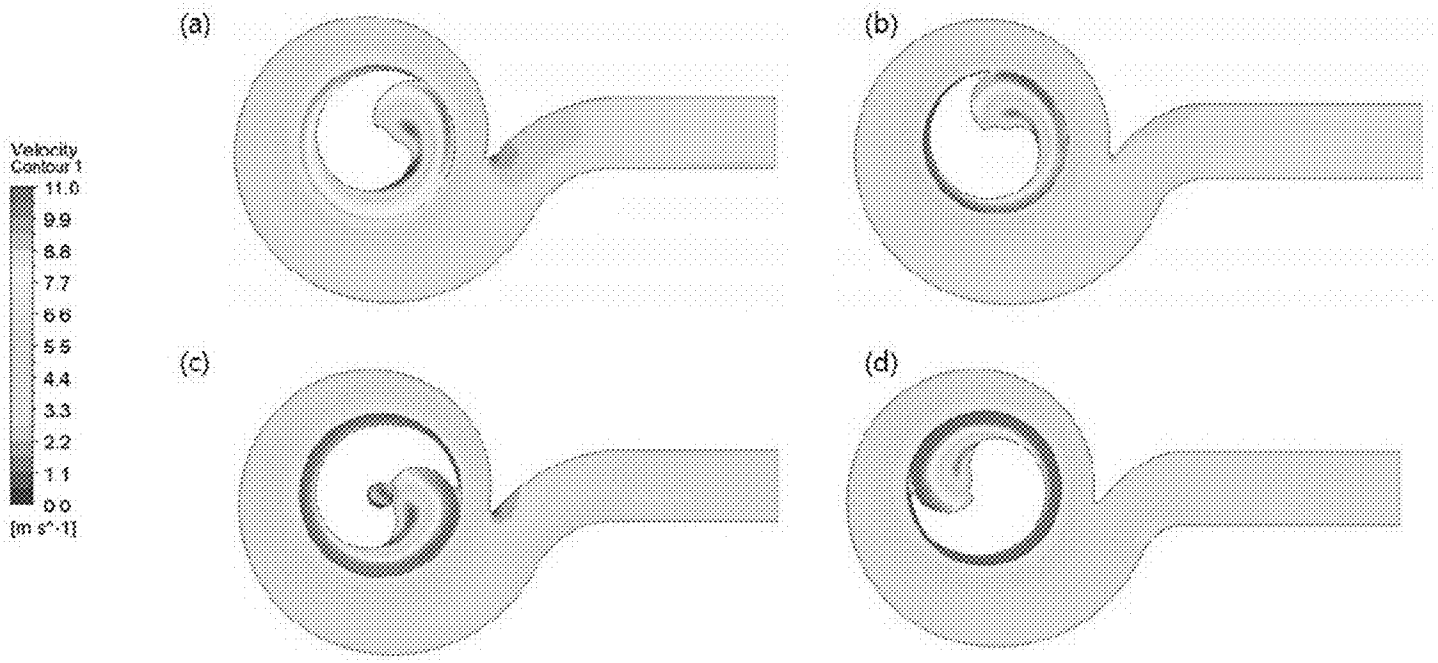

FIG. 37 is a view related to the fluid flow velocity distribution in the volute 100, in which FIG. 37(*a*) is a view related to the pump of the first embodiment, FIG. 37(*b*) is a view related to the pump of the first comparative example, FIG. 37(*c*) is a view related to the pump of the second embodiment, and FIG. 37(*d*) is a view related to the pump of the second comparative example.

Figure 38:
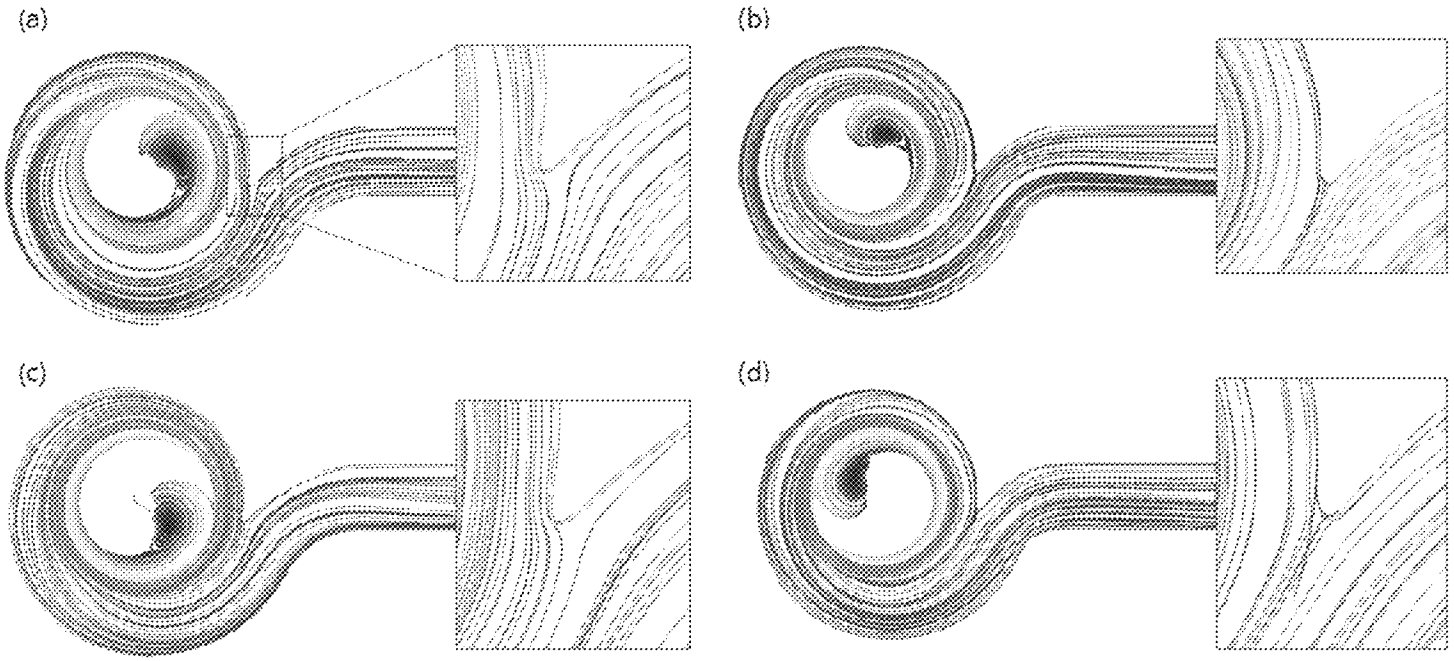

FIG. 38 is a view related to the fluid flow line distribution in the volute 100, in which FIG. 38(*a*) is a view related to the pump of the first embodiment, FIG. 38(*b*) is a view related to the pump of the first comparative example, FIG. 38(*c*) is a view related to the pump of the second embodiment, and FIG. 38(*d*) is a view related to the pump of the second comparative example.

Figure 39:
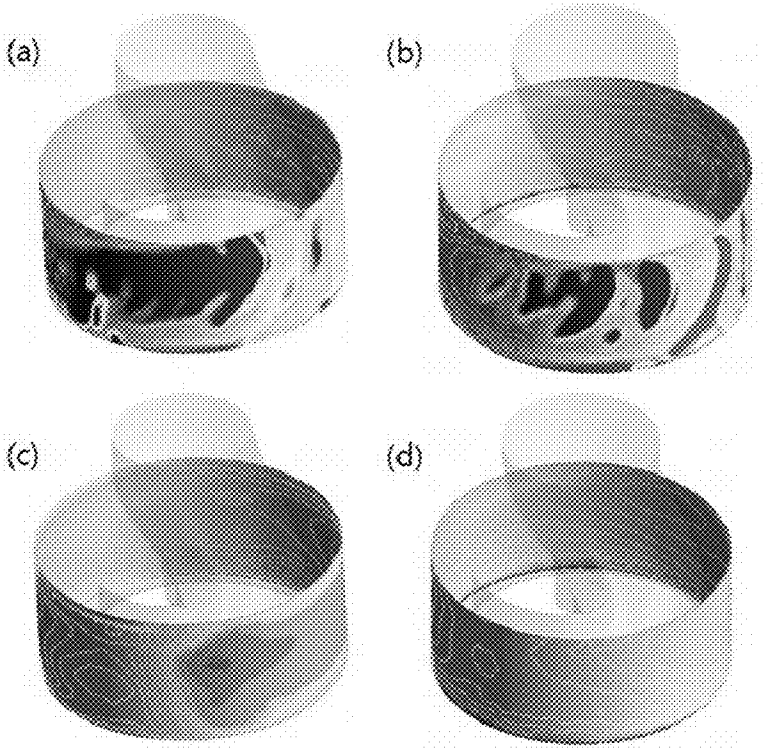
Figure 39:
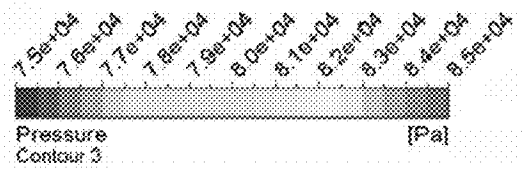

FIG. 39 is a view related to the pressure distribution of the lateral portion of the impeller 200 and the pressure distribution in the volute 100, in which FIG. 39(*a*) is a view related to the pressure distribution of the lateral portion of the impeller 200 of the pump of the first embodiment, FIG. 39(*b*) is a view related to the pressure distribution of the lateral portion of the impeller 200 of the pump of the first comparative example, FIG. 39 (*c*) is a view related to the pressure distribution in the volute 100 of the pump of the first embodiment, and FIG. 39(*d*) is a view related to the pressure distribution in the volute 100 of the pump of the first comparative example.

Figure 40:
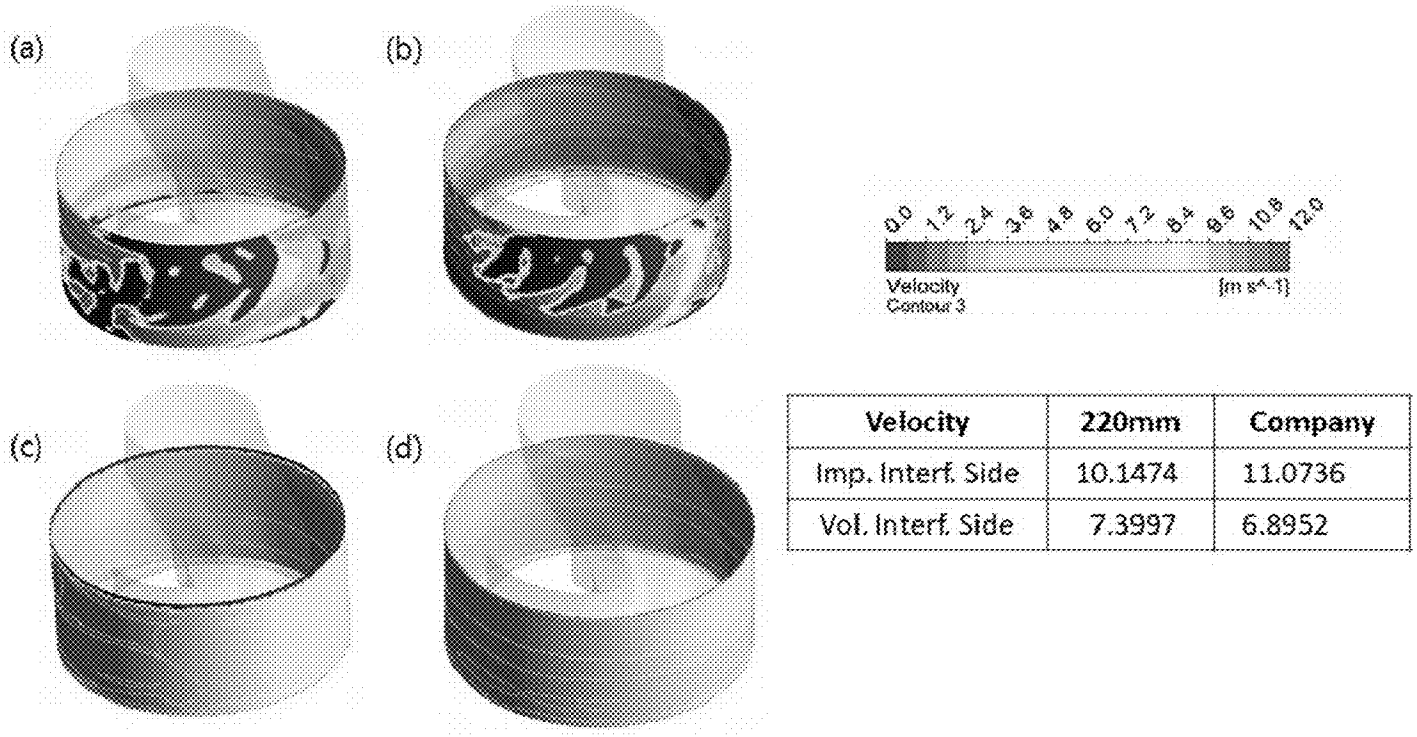

FIG. 40 is a view related to the velocity distribution of the lateral portion of the impeller 200 and the pressure distribution in the volute 100, in which FIG. 40(*a*) is a view related to the pressure distribution of the lateral portion of the impeller 200 of the pump of the first embodiment, FIG. 40(*b*) is a view related to the pressure distribution of the lateral portion of the impeller 200 of the pump of the first comparative example, FIG. 40 (*c*) is a view related to the pressure distribution in the volute 100 of the pump of the first embodiment, and FIG. 40(*d*) is a view related to the pressure distribution in the volute 100 of the pump of the first comparative example.

As illustrated in FIGS. 35, 36, and 39, it can be ascertained that in comparison with the pumps of the comparative examples, the pressure deviation is small, and the average pressure is lower in the pumps of the embodiments.

Further, as illustrated in FIGS. 37 and 40, it can be ascertained that in comparison with the pumps of the comparative examples, the flow velocity deviation is small in the pumps of the embodiments. As illustrated in FIG. 38, it can be ascertained that in comparison with the pumps of the comparative examples, the flow line deviation is small in the pumps of the embodiments. Therefore, it can be ascertained that the low vibration and the high efficiency are implemented in the single-channel pump by the optimization design according to the design method of the present invention.

FIGS. 41 to 49 are images related to a flow of the fluid in the volute 100 of the embodiment of the present invention or the comparative example.

Figure 41:
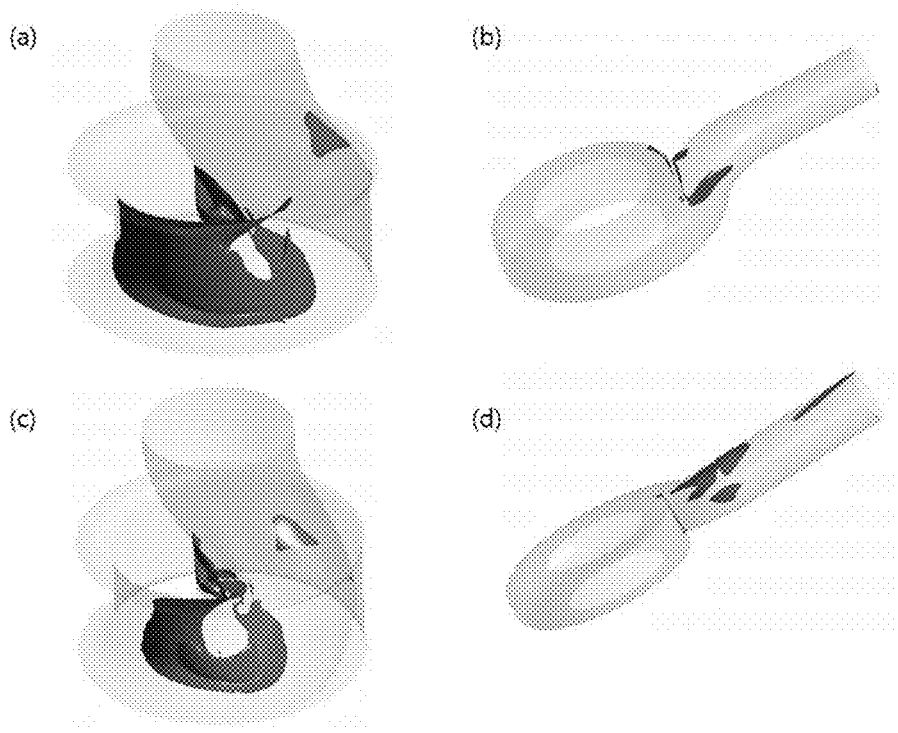
FIGS. 41 to 44 are images related to a flow of the fluid in the volute of the embodiment of the present invention or the comparative example.
Figure 42:
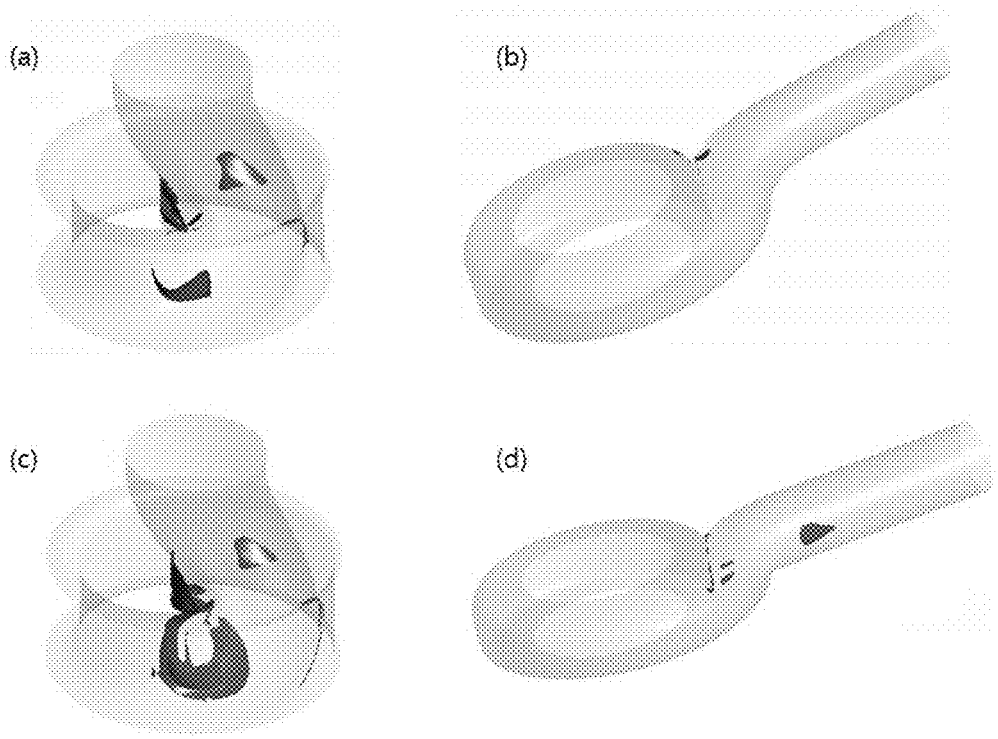

FIGS. 41 and 42 are three-dimensional images of the flows of the fluid in the volute 100 and illustrate a result of the time-averaged (Trnavg) analysis when the flow velocity is 1 m/s. In this case, FIGS. 41(*a*) and (*b*) are views related to the pump of the first embodiment, and FIGS. 41(*c*) and (*d*) are views related to the pump of the first comparative example. Further, FIGS. 42(*a*) and (*b*) are views related to the pump of the second embodiment, and FIGS. 42(*c*) and (*d*) are views related to the pump of the second comparative example.

Figure 43:
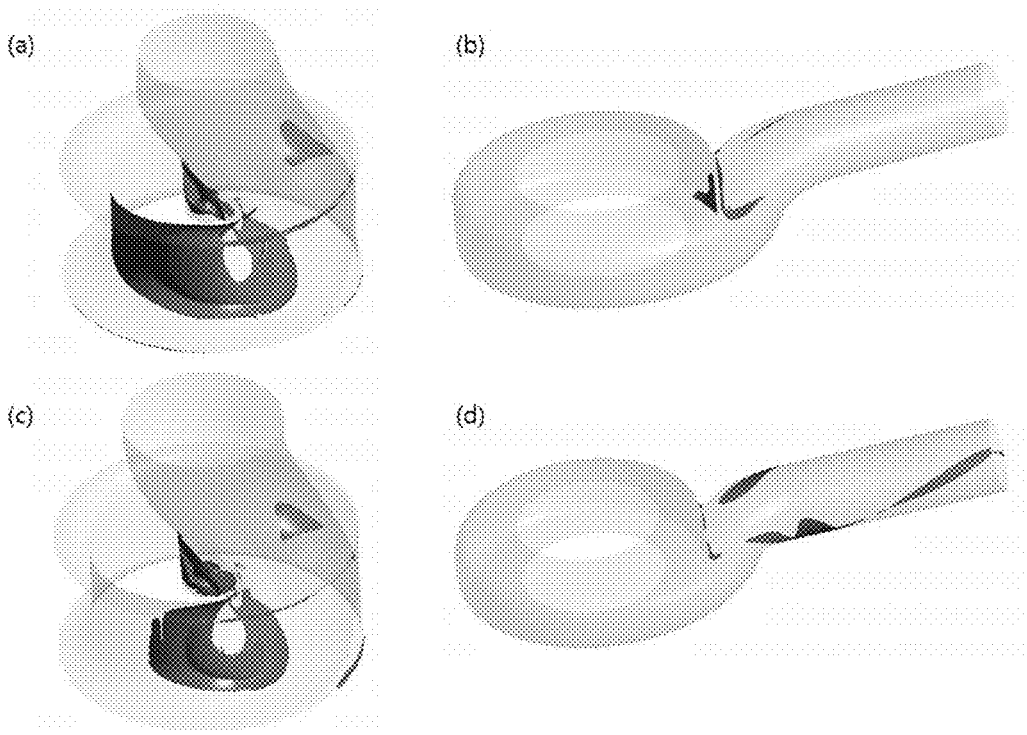
Figure 44:
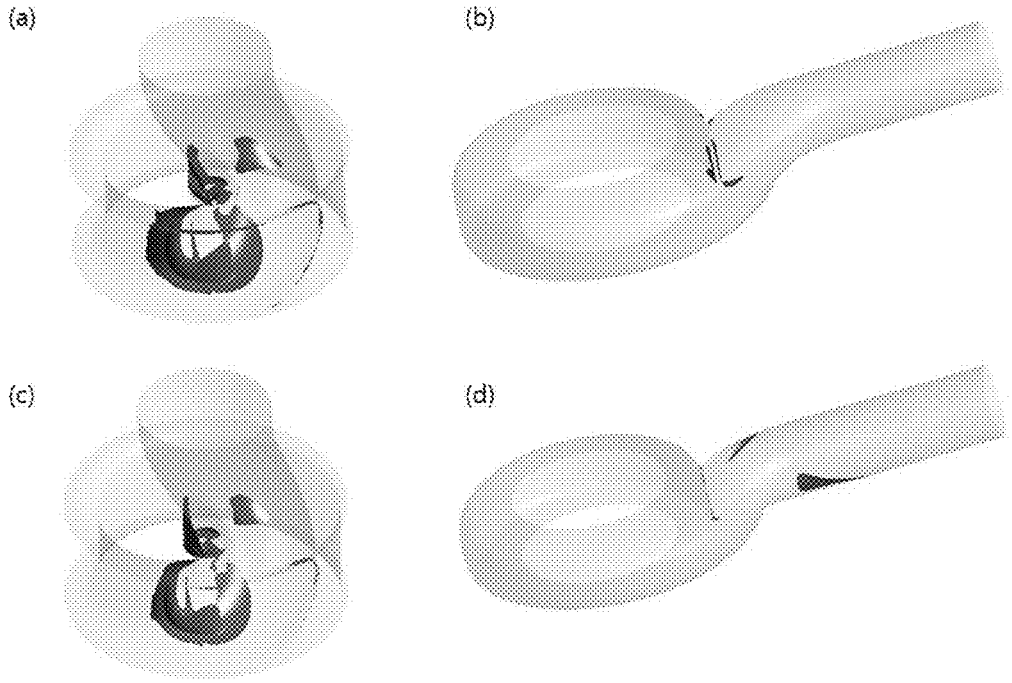

FIGS. 43 and 44 are three-dimensional images of the flows of the fluid in the volute 100 when the flow velocity is 1 m/s. In this case, FIGS. 43(*a*) and (*b*) are views related to the pump of the first embodiment, and FIGS. 43(*c*) and (*d*) are views related to the pump of the first comparative example. Further, FIGS. 44(*a*) and (*b*) are views related to the pump of the second embodiment, and FIGS. 44(*c*) and (*d*) are views related to the pump of the second comparative example.

As illustrated in FIGS. 41 to 44, it can be ascertained that in comparison with the pumps of the comparative examples, the occurrence of vortices is relatively low in the pumps of the embodiments. Therefore, it can be ascertained that the low vibration and the high efficiency are implemented in the single-channel pump by the optimization design according to the design method of the present invention.

FIGS. 45 to 48 are images related to a flow of the fluid in an analytical cross-sectional area in the volute 100 of the embodiment of the present invention or the comparative example.

Figure 45:
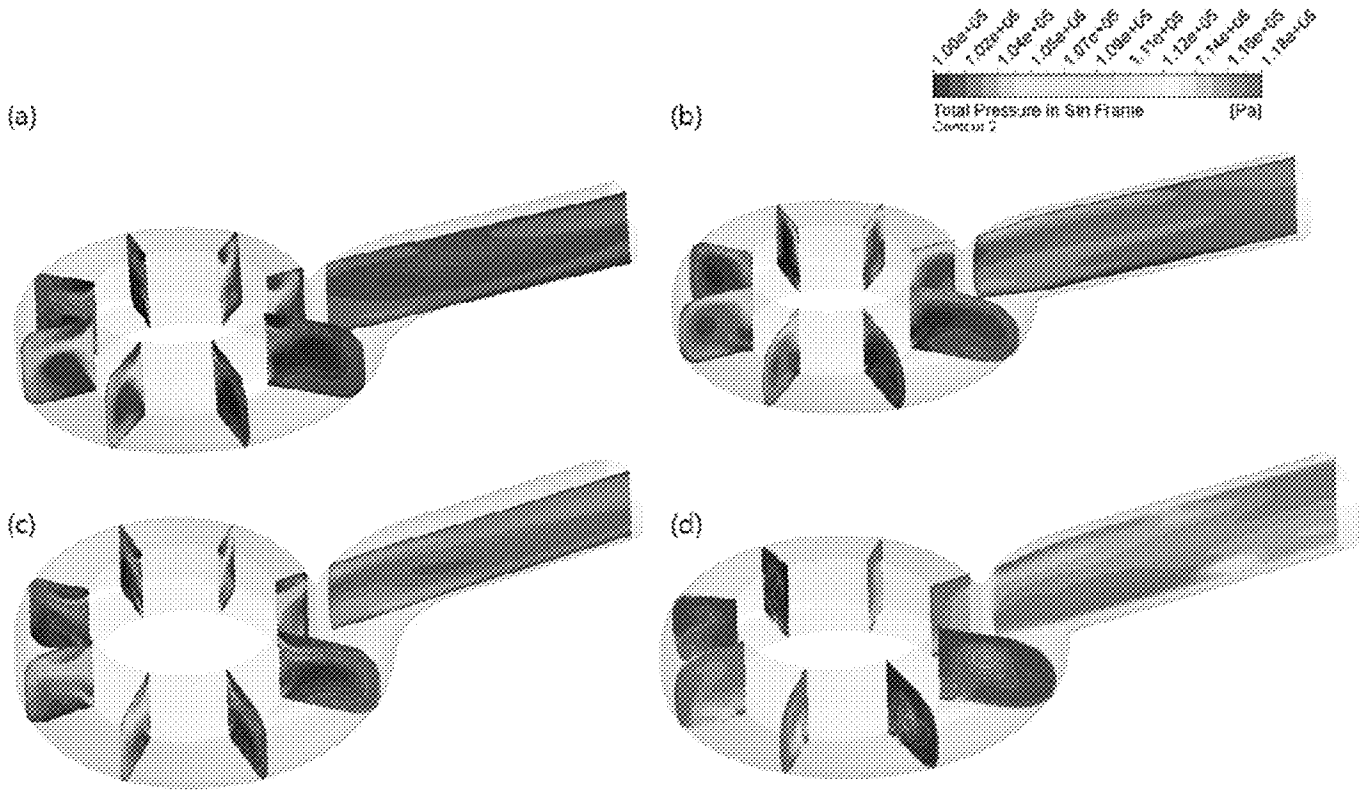
FIGS. 45 to 48 are images related to a flow of the fluid in an analytical cross-sectional area in the volute of the embodiment of the present invention or the comparative example.

FIG. 45 is a view related to the distribution of the total pressure in Stn frame of the fluid in the volute 100 and illustrates the result of performing the analysis on the analytical cross-sectional area and the cross-sectional area of the outlet pipe 120, in which FIG. 45(*a*) is a view related to the pump of the first embodiment, FIG. 45(*b*) is a view related to the pump of the first comparative example, FIG. 45(*c*) is a view related to the pump of the second embodiment, and FIG. 45(*d*) is a view related to the pump of the second comparative example.

Figure 46:
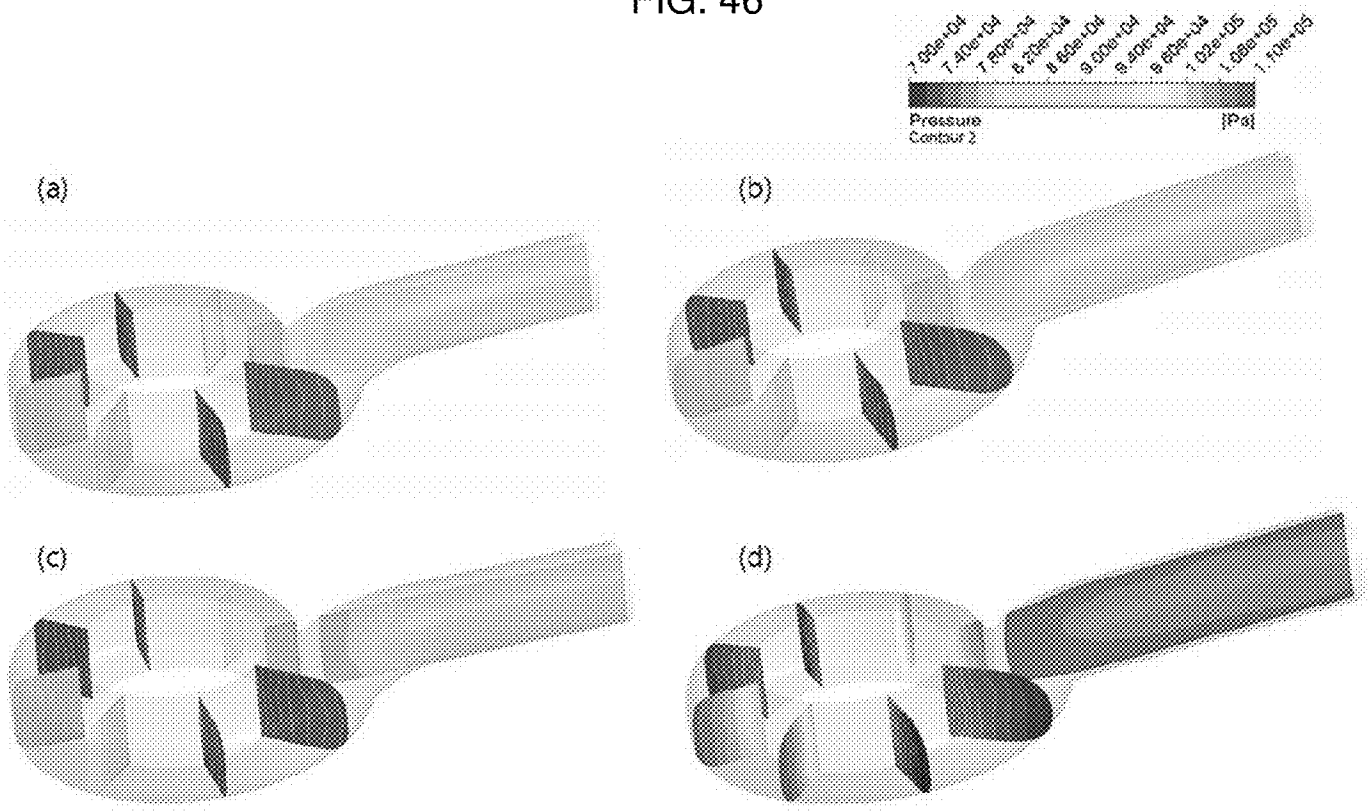

FIG. 46 is a view related to the pressure distribution of the fluid in the volute 100 and illustrates the result of performing the analysis on the analytical cross-sectional area and the cross-sectional area of the outlet pipe 120, in which FIG. 46(*a*) is a view related to the pump of the first embodiment, FIG. 46(*b*) is a view related to the pump of the first comparative example, FIG. 46(*c*) is a view related to the pump of the second embodiment, and FIG. 46(*d*) is a view related to the pump of the second comparative example.

Figure 47:
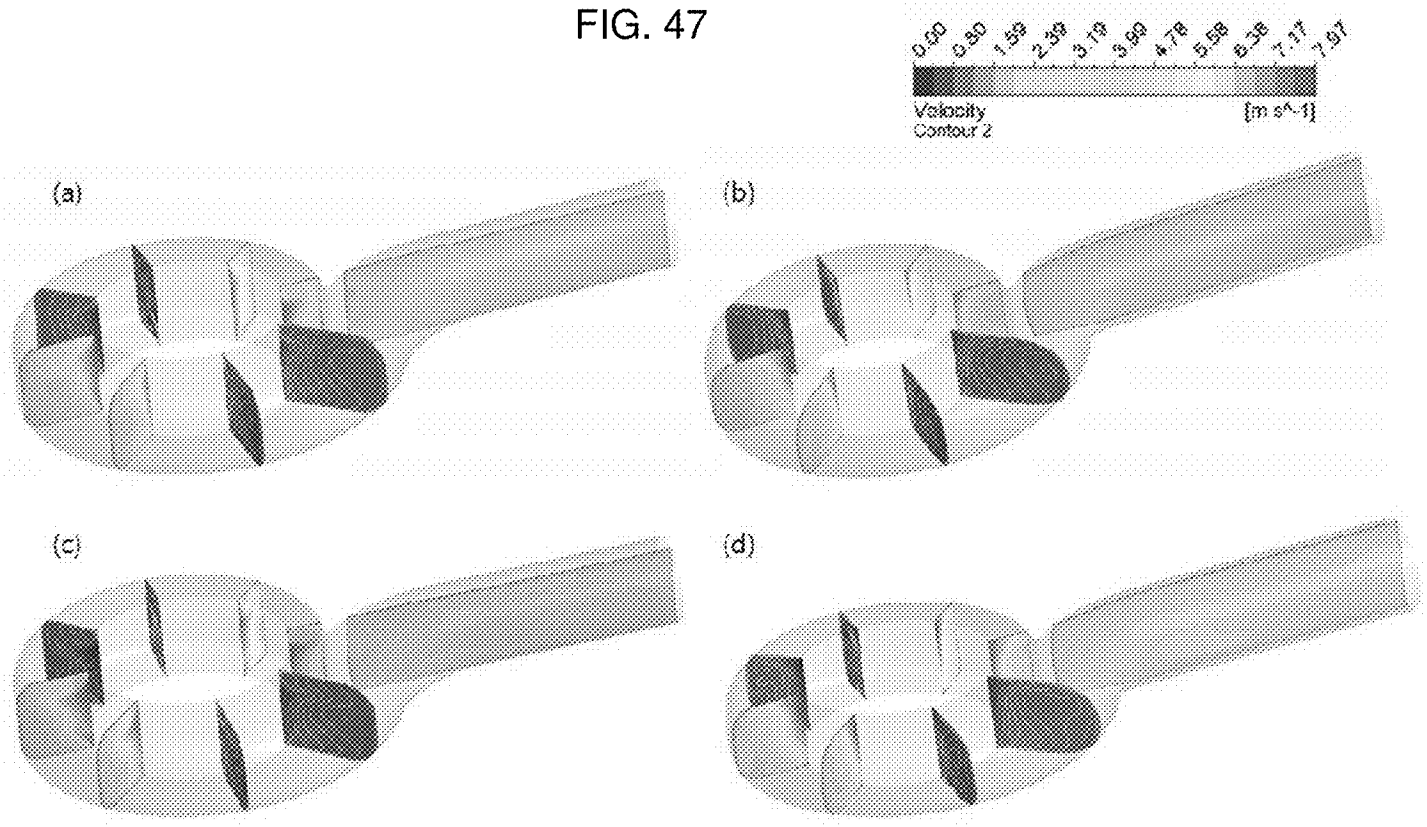

FIG. 47 is a view related to the flow velocity distribution of the fluid in the volute 100 and illustrates the result of performing the analysis on the analytical cross-sectional area and the cross-sectional area of the outlet pipe 120, in which FIG. 47(*a*) is a view related to the pump of the first embodiment, FIG. 47(*b*) is a view related to the pump of the first comparative example, FIG. 47(*c*) is a view related to the pump of the second embodiment, and FIG. 47(*d*) is a view related to the pump of the second comparative example.

Figure 48:
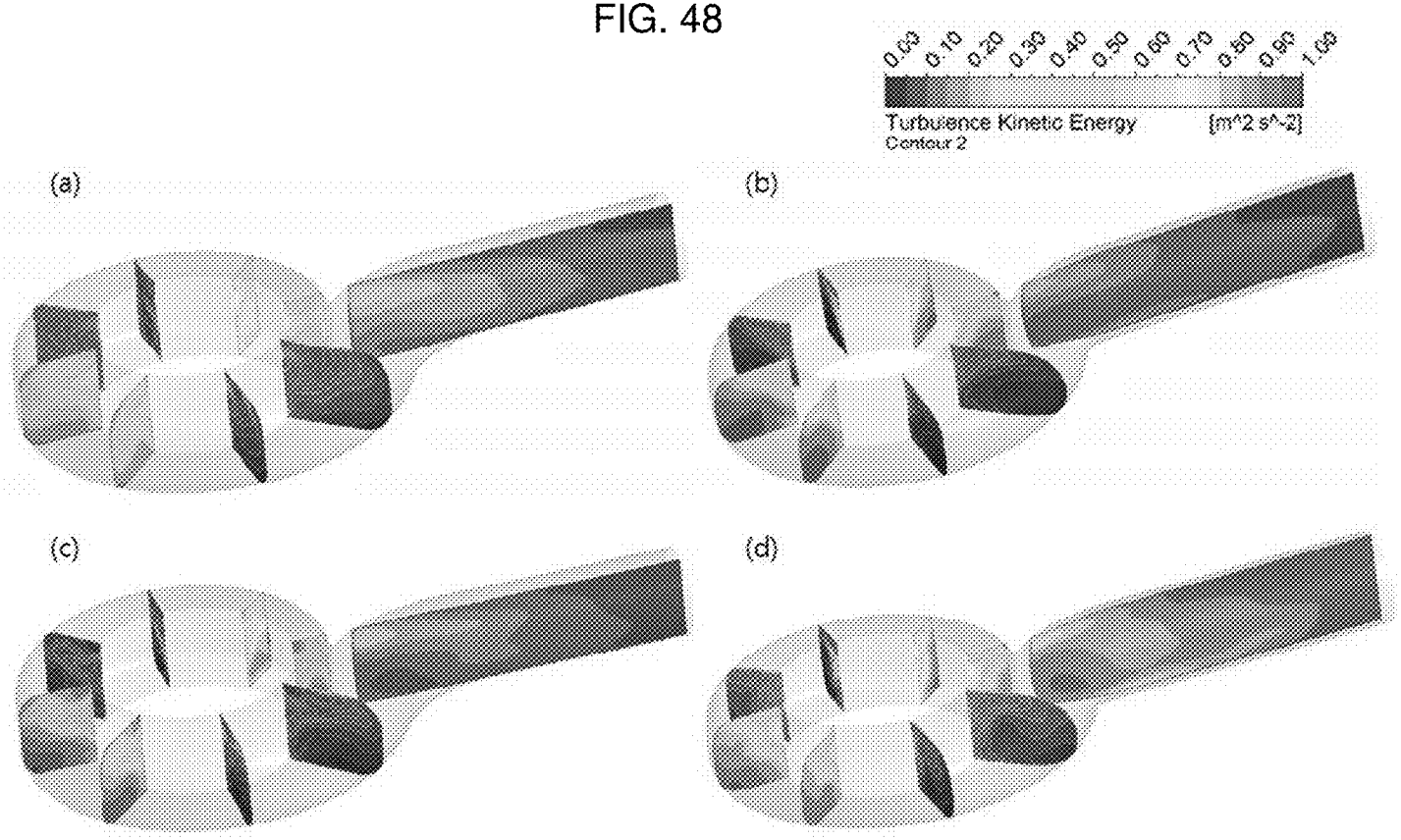

FIG. 48 is a view related to the turbulence kinetic energy (TKE) distribution of the fluid in the volute 100 and illustrates the result of performing the analysis on the analytical cross-sectional area and the cross-sectional area of the outlet pipe 120, in which FIG. 48(*a*) is a view related to the pump of the first embodiment, FIG. 48(*b*) is a view related to the pump of the first comparative example, FIG. 48(*c*) is a view related to the pump of the second embodiment, and FIG. 48(*d*) is a view related to the pump of the second comparative example.

As illustrated in FIGS. 45, and 46, it can be ascertained that in comparison with the pumps of the comparative examples, the pressure deviation is small, and the average pressure is lower in the pumps of the embodiments.

Further, as illustrated in FIG. 47, it can be ascertained that in comparison with the pumps of the comparative examples, the flow velocity deviation is small in the pumps of the embodiments. As illustrated in FIG. 48, it can be ascertained that in comparison with the pumps of the comparative examples, the TKE deviation is small in the pumps of the embodiments. It can be ascertained that with the above-mentioned configuration, the low vibration and the like are implemented in the single-channel pump by the design method of the present invention.

FIGS. 49 to 52 are images related to a flow of the fluid in the volute 100 and the inlet pipe 130 of the embodiment of the present invention or the comparative example.

Figure 49:
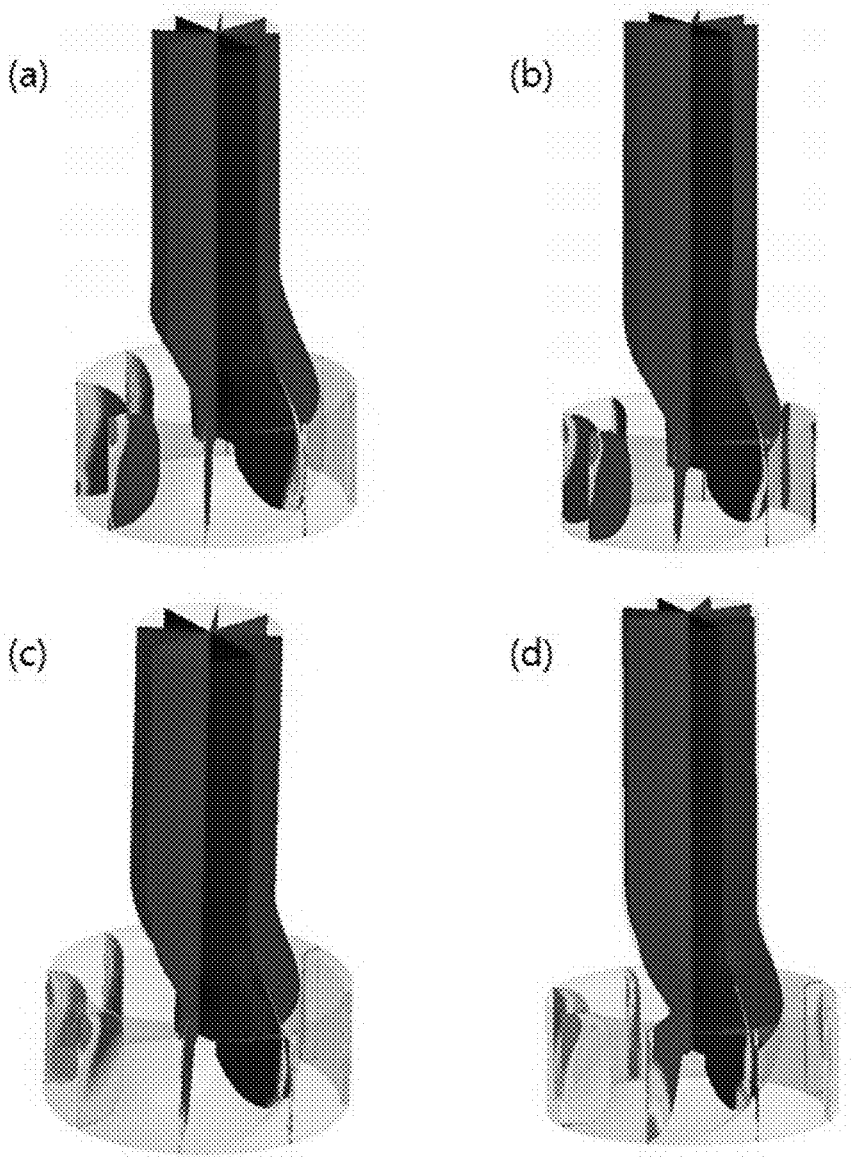
FIGS. 49 to 52 are images related to a flow of the fluid in the volute and an inlet pipe of the embodiment of the present invention or the comparative example.

FIG. 49 is a view related to the distribution of the total pressure in Stn frame of the fluid in the volute 100 and illustrates the result of performing the analysis on the analytical cross-sectional area and the cross-sectional area of the inlet pipe 130, in which FIG. 49(*a*) is a view related to the pump of the first embodiment, FIG. 49(*b*) is a view related to the pump of the first comparative example, FIG. 49(*c*) is a view related to the pump of the second embodiment, and FIG. 49(*d*) is a view related to the pump of the second comparative example.

Figure 50:
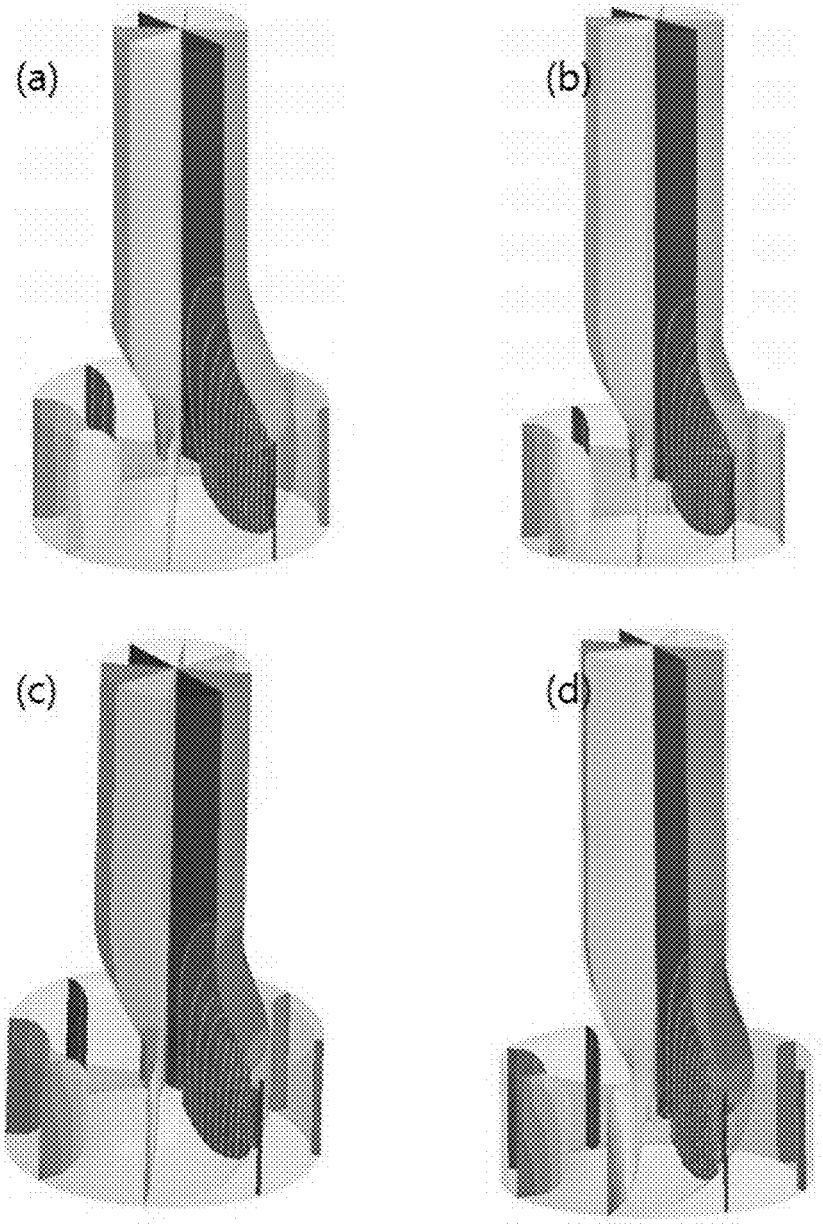

FIG. 50 is a view related to the pressure distribution of the fluid in the volute 100 and illustrates the result of performing the analysis on the analytical cross-sectional area and the cross-sectional area of the inlet pipe 130, in which FIG. 50(*a*) is a view related to the pump of the first embodiment, FIG. 50(*b*) is a view related to the pump of the first comparative example, FIG. 50(*c*) is a view related to the pump of the second embodiment, and FIG. 50(*d*) is a view related to the pump of the second comparative example.

Figure 51:
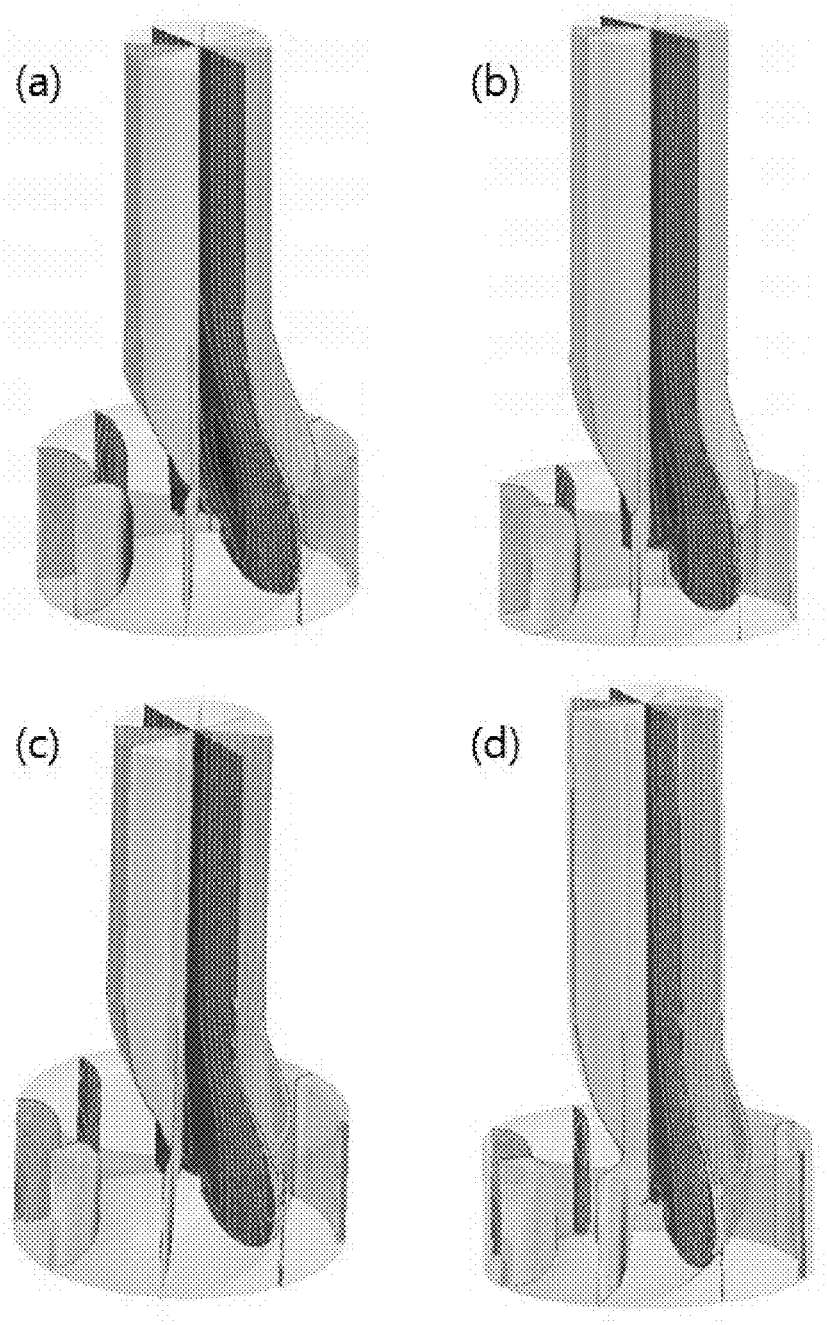

FIG. 51 is a view related to the flow velocity distribution of the fluid in the volute 100 and illustrates the result of performing the analysis on the analytical cross-sectional area and the cross-sectional area of the inlet pipe 130, in which FIG. 51(*a*) is a view related to the pump of the first embodiment, FIG. 51(*b*) is a view related to the pump of the first comparative example, FIG. 51(*c*) is a view related to the pump of the second embodiment, and FIG. 51(*d*) is a view related to the pump of the second comparative example.

Figure 52:
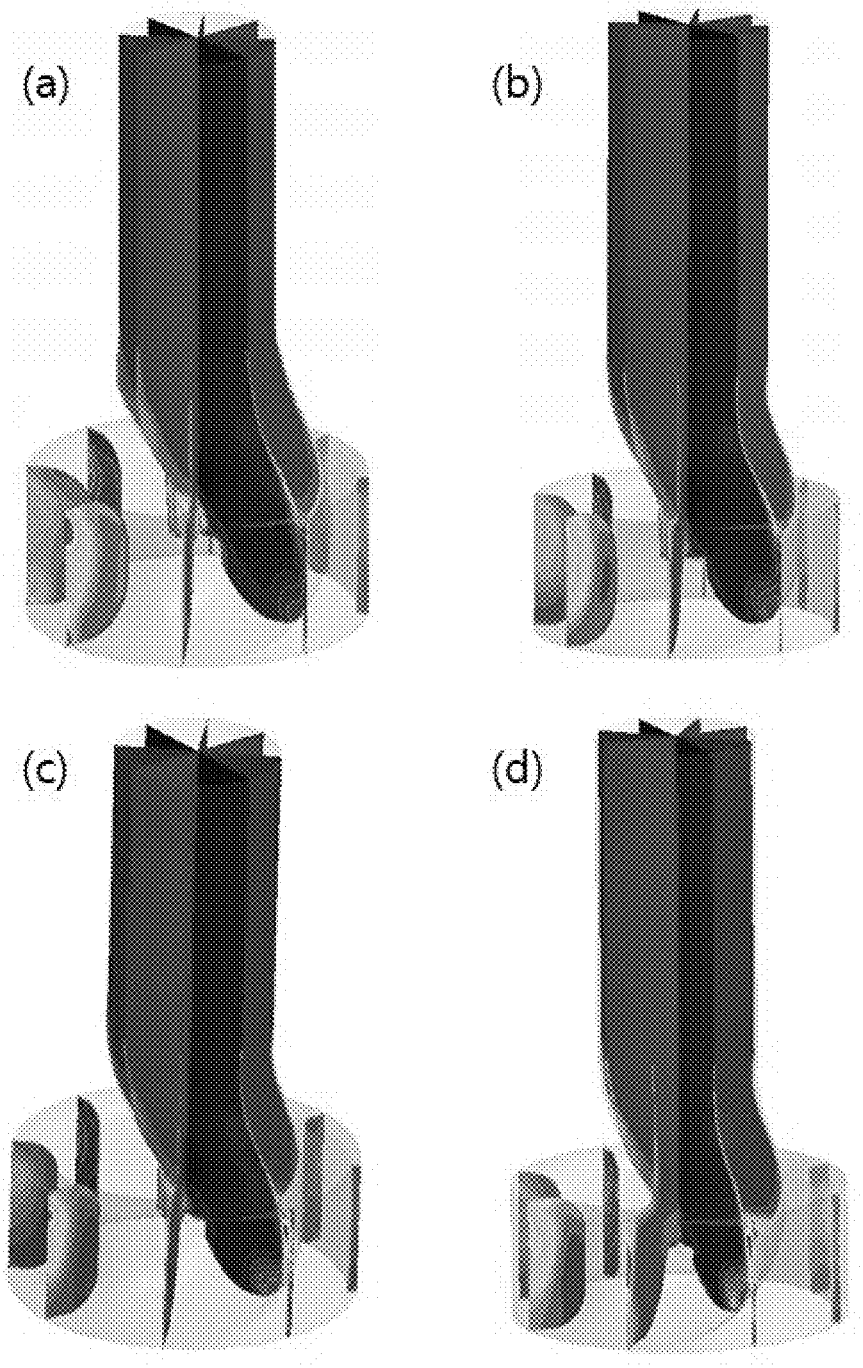

FIG. 52 is a view related to the turbulence kinetic energy (TKE) distribution of the fluid in the volute 100 and illustrates the result of performing the analysis on the analytical cross-sectional area and the cross-sectional area of the inlet pipe 130, in which FIG. 52(*a*) is a view related to the pump of the first embodiment, FIG. 52(*b*) is a view related to the pump of the first comparative example, FIG. 52(*c*) is a view related to the pump of the second embodiment, and FIG. 52(*d*) is a view related to the pump of the second comparative example.

As illustrated in FIGS. 49, and 50, it can be ascertained that in comparison with the pumps of the comparative examples, the pressure deviation is small, and the average pressure is lower in the pumps of the embodiments.

Further, as illustrated in FIG. 51, it can be ascertained that in comparison with the pumps of the comparative examples, the flow velocity deviation is small in the pumps of the embodiments. As illustrated in FIG. 52, it can be ascertained that in comparison with the pumps of the comparative examples, the TKE deviation is small in the pumps of the embodiments. It can be ascertained that with the above-mentioned configuration, the low vibration and the like are implemented in the single-channel pump by the design method of the present invention.

It will be appreciated that the embodiments of the present invention have been described above for purposes of illustration, and those skilled in the art may understand that the present invention may be easily modified in other specific forms without changing the technical spirit or the essential features of the present invention. Therefore, it should be understood that the above-described embodiments are illustrative in all aspects and do not limit the present application. For example, each component described as a single type may be carried out in a distributed manner. Likewise, components described as a distributed type can be carried out in a combined type.

The scope of the present invention is represented by the claims to be described below, and it should be interpreted that the meaning and scope of the claims and all the changes or modified forms derived from the equivalent concepts thereto fall within the scope of the present invention.

DESCRIPTION OF REFERENCE NUMERALS

10: Analytical cross-sectional area
100: Volute
110: Spiral part
120: Outlet pipe
130: Inlet pipe
200: Impeller
210: Rotation channel

The invention claimed is:

1. A method of designing a single-channel pump comprising a volute configured to provide a turning channel to a fluid introduced from the outside, and an impeller configured to rotate and having a single channel through which the fluid having passed through the volute passes, the method comprising:

a first step of determining a shape of the volute and setting a plurality of points inside and outside the volute;

a second step of selecting a target value, which is a value for a performance numerical value of the single-channel pump, and determining a shape of the impeller suitable for the target value;

a third step of setting an analytical cross-sectional area, which is a channel cross-sectional area that adjoins inner and outer points in the volute, and setting a plurality of analytical cross-sectional areas for a plurality of portions in the volute, wherein each analytical cross-sectional area includes one inner point and one outer point that are adjacent to each other and are positioned on an axis of the volute in a diameter direction, and the plurality of analytical cross-sectional areas are formed in a flow direction of a fluid passing through a spiral part of the volute;

a fourth step of setting a structure design variable, which is a structural variable of the single-channel pump, and deriving the target value by a numerical analysis; and a fifth step of deriving, as a design plan, a structure design variable value that is a value of the structure design variable that allows the target value to satisfy a preset set target value, wherein the numerical analysis is performed on the plurality of analytical cross-sectional areas and computation is continuously performed until the target value satisfies the preset set target value.

2. The method of claim 1, wherein the structure design variable is a maximum diameter of the volute.

3. The method of claim 1, wherein in the second step, the target value is an output of the single-channel pump.

4. The method of claim 1, wherein in the fourth step, a finite volume method is used for the numerical analysis.

5. The method of claim 1, wherein the structure design variable value is changed by determining a shape of the impeller.

6. The method of claim 1, wherein the target value is changed by changing the structure design variable value.

7. The method of claim 1, wherein the impeller has a rotation channel that is a channel configured to connect an inlet port at a lower side and an outlet port at a lateral side and having a spiral shape.

8. The method of claim 1, wherein the volute has a spiral part that is a spiral portion surrounding the impeller, and the volute discharges the fluid, which has passed through the impeller, to the outside.

9. The method of claim 8, wherein a channel cross-sectional shape of the spiral part is a rectangular shape having an edge portion curved toward the outside.

10. A single-channel pump designed by a method of designing a single-channel pump according to claim 1, the single-channel pump comprising:

a volute configured to provide a turning channel to a fluid introduced from the outside; and an impeller configured to rotate and having a single channel through which the fluid having passed through the volute passes.

11. The single-channel pump of claim 10, wherein the volute has a spiral part that is a spiral portion surrounding the impeller.

12. The single-channel pump of claim 10, wherein the impeller has a rotation channel that is a channel configured to connect an inlet port at a lower side and an outlet port at a lateral side and having a spiral shape.

* * * * *